US006259407B1

(12) United States Patent
Tran

(10) Patent No.: US 6,259,407 B1
(45) Date of Patent: Jul. 10, 2001

(54) UNIPLANAR DUAL STRIP ANTENNA

(76) Inventor: Allen Tran, 7529 Flower Meadow Dr., San Diego, CA (US) 92126

( * ) Notice: Subject to any disclaimer, the term of this patent is extended or adjusted under 35 U.S.C. 154(b) by 0 days.

(21) Appl. No.: 09/252,732

(22) Filed: Feb. 19, 1999

(51) Int. Cl.[7] ..... H01Q 1/38
(52) U.S. Cl. ..... 343/700 MS; 343/702
(58) Field of Search ..... 343/700 MS, 702, 343/795, 846, 848

(56) References Cited

U.S. PATENT DOCUMENTS

| | | | | |
|---|---|---|---|---|
| 4,313,095 | | 1/1982 | Jean-Frederic | 333/116 |
| 4,356,492 | * | 10/1982 | Kaloi | 343/700 MS |
| 4,495,505 | | 1/1985 | Shields | 343/821 |
| 5,075,691 | * | 12/1991 | Garay et al. | 343/830 |
| 5,270,722 | * | 12/1993 | Delestre | 343/700 MS |
| 5,363,114 | | 11/1994 | Shoemaker | 343/828 |
| 5,898,405 | * | 4/1999 | Iwasaki | 343/700 MS |
| 5,903,240 | * | 5/1999 | Kawahata et al. | 343/700 MS |
| 5,933,115 | * | 8/1999 | Faraone et al. | 343/700 MS |
| 5,949,383 | * | 9/1999 | Hayes et al. | 343/795 |

FOREIGN PATENT DOCUMENTS

| | | | |
|---|---|---|---|
| 9744856 | 11/1997 | (WO) | H01Q/9/04 |

* cited by examiner

*Primary Examiner*—Tan Ho
(74) *Attorney, Agent, or Firm*—Philip Wadsworth; Charles Brown; Christopher Edwards

(57) ABSTRACT

A uniplanar dual strip antenna that has a two dimensional structure. The antenna is comprised of a first and a second metallic strip, each printed or etched on a thin planar substrate. The first and second strips are separated by a predetermined gap and are used as conductors of a two-wire transmission line. A coplanar waveguide is coupled to the uniplanar dual strip antenna. The coplanar waveguide is constructed by printing or etching metal on the substrate. The positive terminal of the waveguide is electrically connected to the first strip. The negative terminal of the waveguide is electrically connected to both the first and second strips. The uniplanar dual strip antenna according to the present invention provides an increase in bandwidth over typical quarter wavelength or half wavelength patch antennas. Experimental results have shown that the uniplanar dual strip antenna has a bandwidth of approximately 8–20% that is extremely desirable for PCS and cellular phones.

13 Claims, 17 Drawing Sheets

FIG. 9A
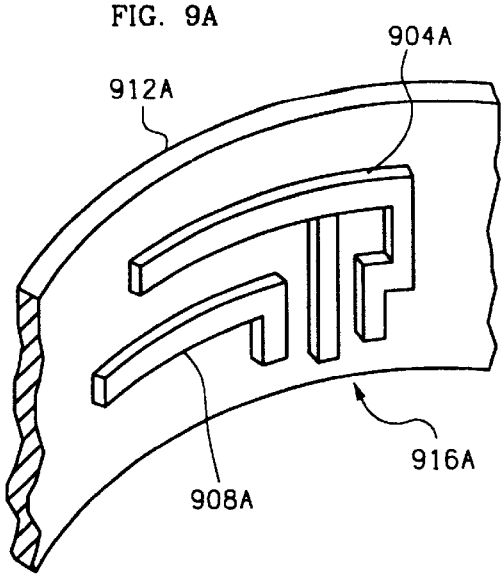
FIG. 9B
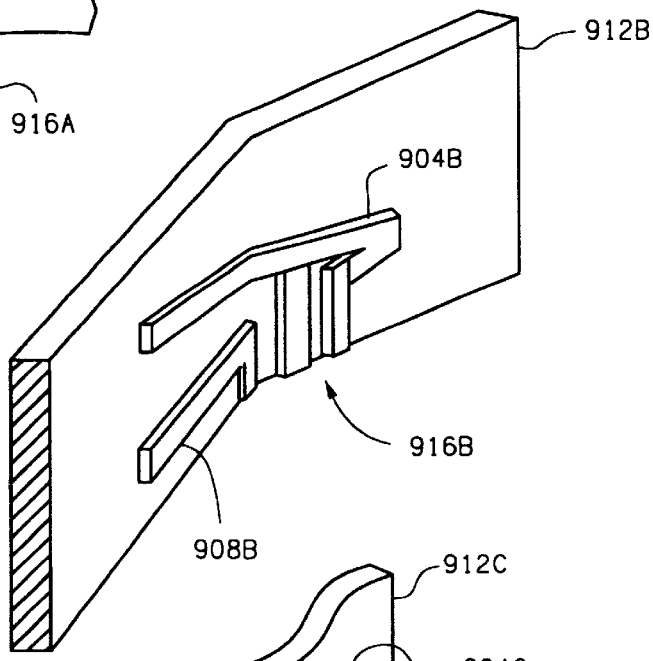
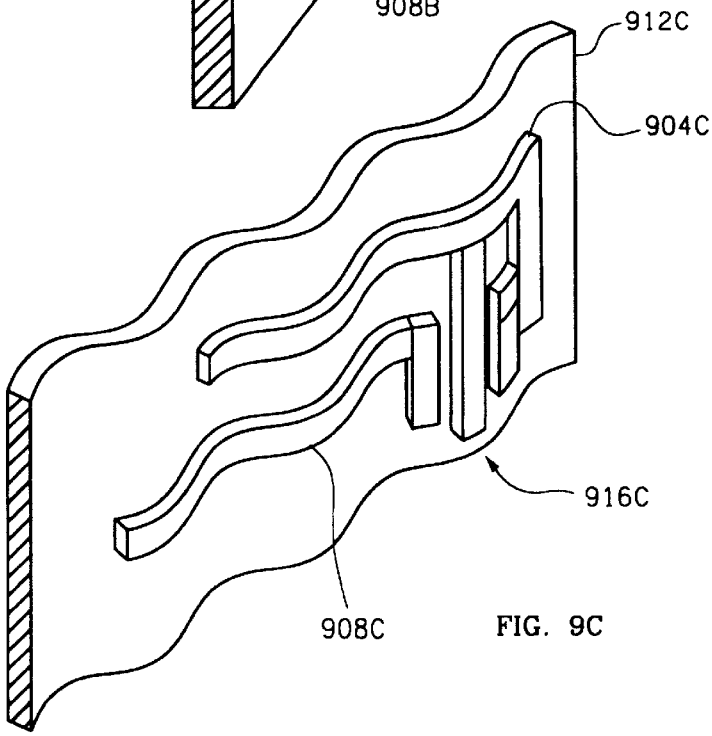
FIG. 9C

UNIPLANAR DUAL STRIP ANTENNA

RELATED APPLICATIONS

This application is related to patent applications, entitled "Multi-Layered Shielded Substrate Antenna" having application Ser. No. 9/059,605, and "Dual Strip Antenna" having application Ser. No. 09/090,478 which are incorporated herein by reference.

BACKGROUND OF THE INVENTION

I. Field of the Invention

The present invention relates generally to antennas, and more particularly, to a uniplanar dual strip multiple frequency antenna. The invention further relates to internal antennas for wireless devices, especially having improved bandwidth and radiation characteristics.

II. Description of the Related Art

Antennas are an important component of wireless communication devices and systems. Although antennas are available in numerous different shapes and sizes, they each operate according to the same basic electromagnetic principles. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with an increase in use of personal wireless communication devices, such as hand-held and mobile cellular and personal communication services (PCS) phones, the need for suitable small antennas for such communication devices has increased. Recent developments in integrated circuits and battery technology have enabled the size and weight of such communication devices to be reduced drastically over the past several years. One area in which a reduction in size is still desired is communication device antennas. This is due to the fact that the size of the antenna can play an important role in decreasing the size of the device. In addition, the antenna size and shape impacts device aesthetics and manufacturing costs.

One important factor to consider in designing antennas for wireless communication devices is the antenna radiation pattern. In a typical application, the communication device must be able to communicate with another such device or a base station, hub, or satellite which can be located in any number of directions from the device. Consequently, it is essential that the antennas for such wireless communication devices have an approximately omnidirectional radiation pattern.

Another important factor to be considered in designing antennas for wireless communication devices is the antenna's bandwidth. For example, wireless devices such as phones used with PCS communication systems operate over a frequency band of 1.85–1.99 GHz, thus, requiring a useful bandwidth of 7.29 percent. A phone for use with typical cellular communication systems operates over a frequency band of 824–894 MHz, which requires a bandwidth of 8.14 percent. Accordingly, antennas for use on these types of wireless communication devices must be designed to meet the appropriate bandwidth requirements, or communication signals are severely attenuated.

One type of antenna commonly used in wireless communication devices is the whip antenna, which is easily retracted into the device when not in use. There are, however, several disadvantages associated with the whip antenna. Often, the whip antenna is subject to damage by catching on objects, people, or surfaces when extended for use, or even when retracted. Even when the whip antenna is designed to be retractable in order to prevent such damage, it can extend across an entire dimension of the device and interfere with placement of advanced features and circuits within some portions of the device. It may also require a minimum device housing dimension when retracted that is larger than desired. While the antenna can be configured with additional telescoping sections to reduce size when retracted, it would generally be perceived as less aesthetic, more flimsy or unstable, or less operational by consumers.

Furthermore, a whip antenna has a radiation pattern that is toroidal in nature, that is, shaped like a donut, with a null at the center. When a cellular phone or other wireless device using such an antenna is held with the antenna perpendicular to the ground, at a 90 degree angle to the ground or local horizontal plane, this null has a central axis that is also inclined at a 90 degree angle. This generally does not prevent reception of signals, because incoming signals are not constrained to arrive at a 90 degree angle relative to the antenna. However, phone users frequently tilt their cellular phones during use, causing any associated whip antenna to be tilted as well. It has been observed that cellular phone users typically tilt their phones at around a 30 degree angle relative to the local horizon (60 degrees from vertical), causing the whip antenna to be inclined at a 30 degree angle. This results in the null central axis also being oriented at a 30 degree angle. At that angle, the null prevents reception of incoming signals arriving at a 30 degree angle. Unfortunately, incoming signals in cellular communication systems often arrive at angles around or in the range of 30 degrees, and there is an increasing likelihood that the mis-oriented null will prevent reception of some signals.

Another type of antenna which might appear suitable for use in wireless communication devices is a conformal antenna. Generally, conformal antennas follow the shape of the surface on which they are mounted and generally exhibit a very low profile. There are several different types of conformal antennas, such as patch, microstrip, and stripline antennas. Microstrip antennas, in particular, have recently been used in personal communication devices.

As the term suggests, a microstrip antenna includes a patch or a microstrip element, which is also commonly referred to as a radiator patch. The length of the microstrip element is set in relation to the wavelength $\lambda_0$ associated with a resonant frequency $f_0$, which is selected to match the frequency of interest, such as 800 MHz or 1900 MHz. Commonly used lengths of microstrip elements are half wavelength ($\lambda_0/2$) and quarter wavelength ($\lambda_0/4$). Although, a few types of microstrip antennas have recently been used in wireless communication devices, further improvement is desired in several areas. One such area in which a further improvement is desired is a reduction in overall size. Another area in which significant improvement is required is in bandwidth. Current patch or microstrip antenna designs do not appear to obtain the desired 7.29 to 8.14 percent or more bandwidth characteristics desired for use in advanced communication systems, in a practical size.

Therefore, a new antenna structure and technique for manufacturing antennas are needed to achieve bandwidths more commensurate with advanced communication system demands. In addition, the antenna structure should be conducive to internal mounting to provide more flexible component positioning within the wireless device, greatly improved aesthetics, and decreased antenna damage.

SUMMARY OF THE INVENTION

The present invention is directed to a uniplanar dual strip antenna having a two-dimensional structure. The uniplanar dual strip antenna includes a first and a second metallic strip, each printed on a thin planar substrate. The first and second strips are separated by a predetermined gap or region of non-conductive material. According to the present invention, the first and second strips are used as conductors of a two-wire transmission line. Air or other dielectric material deposited on the substrate between the strips acts as a dielectric medium between the first and second strips. In one embodiment of the present invention, the length of the first strip is less than the length of the second strip and the width of the first strip is less than the width of the second strip.

A coplanar waveguide is coupled to the uniplanar dual strip antenna. The coplanar waveguide is constructed by etching or depositing metal on the substrate. The positive terminal of the waveguide is electrically connected to the first strip. The negative terminal of the waveguide is electrically connected to both the first and second strips. Alternatively, a coaxial cable can be used instead of a coplanar waveguide as a feed.

In one embodiment of the present invention, the coplanar waveguide has two negative terminals and a positive terminal. The positive terminal is connected to the first strip. A negative terminal is connected to the second strip, while the other negative terminal is connected to the first strip. The negative terminals are electrically interconnected at a convenient location.

In one embodiment of the present invention, the uniplanar dual strip antenna is constructed by printing, etching or depositing metallic strips on a thin flexible substrate. The coplanar waveguide is also etched or deposited on the flexible substrate. In another embodiment of the present invention, the uniplanar dual strip antenna is constructed by etching or depositing metallic strips on a printed circuit (PC) board. This greatly simplifies the fabrication of the dual strip antenna.

In one embodiment of the present invention, the first and second strips are approximately parallel to one another. In another embodiment of the present invention, the first and second strips flare out at the open end as they extend away from where the first and second strips are electrically connected to the coplanar waveguide in order to provide improved impedance matching with air or free space. In yet another embodiment of the present invention, the first and second strips are substantially curved. A variety of other shapes for the first and second strips can also be used.

The uniplanar dual strip antenna according to the present invention provides an increase in bandwidth over typical quarter wavelength or half wavelength patch antennas. Experimental results have shown that the uniplanar dual strip antenna has a bandwidth of approximately 8–20% which is very advantageous for PCS and cellular phones.

BRIEF DESCRIPTION OF THE DRAWINGS

The present invention is described with reference to the accompanying drawings, in which like reference numbers generally indicate identical, functionally similar, and/or structurally similar elements, the drawing in which an element first appears is indicated by the leftmost digit(s) in the reference number, and wherein:

FIGS. 9A–9B illustrate perspective views of several other embodiments of the present invention useful in certain other applications;

DETAILED DESCRIPTION OF THE PREFERRED EMBODIMENTS

Figure 1A:
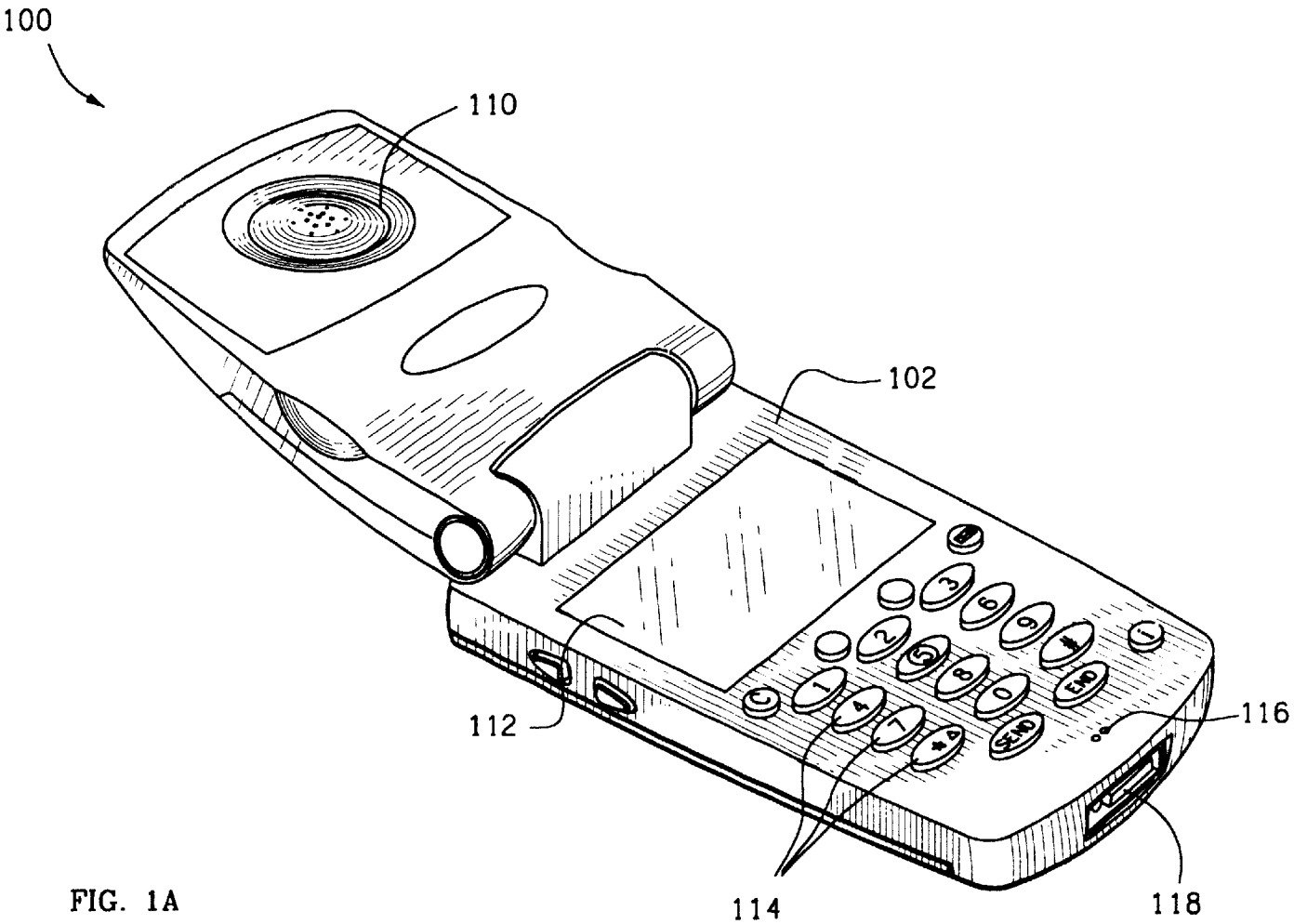
FIGS. 1A and 1B illustrate a portable telephone having whip and external helical antennas.

1. Overview and Discussion of the Invention

While a conventional microstrip antenna possesses some characteristics that make it suitable for use in personal communication devices, further improvement in other areas of the microstrip antenna is still desired in order to make it more desirable for use in wireless communication devices, such as cellular and PCS phones. One such area in which further improvement is desired is its bandwidth. Generally, PCS and cellular phones require approximately 8 percent bandwidth in order to operate satisfactorily. Since the bandwidth of currently available microstrip antennas falls approximately in the range of 1–2 percent, an increase in their bandwidth is desired in order to be more suitable for use in PCS and cellular phones.

Another area in which further improvement is desired is the size of a microstrip antenna. For example, a reduction in the size of a microstrip antenna would make a wireless communication device in which it is used more compact and aesthetic. In fact, this might even determine whether or not such an antenna can be used in a wireless communication device at all. In the past, a reduction in the size of a conventional microstrip antenna was made possible by reducing the thickness of any dielectric substrate employed, or increasing the dielectric constant. This, however, had the undesirable effect of reducing the antenna bandwidth, thereby making it less suitable for wireless communication devices.

Furthermore, the field pattern of conventional microstrip antennas, such as patch radiators, is typically directional. Most patch radiators radiate only in an upper hemisphere relative to a local horizon for the antenna. As stated earlier, this pattern moves or rotates with movement of the device and can create undesirable nulls in coverage. Therefore, microstrip antennas have not been very desirable for use in many wireless communication devices based on their radiation pattern.

The present invention provides a solution to the above and other problems. The present invention is directed to a uniplanar dual strip antenna that has a two-dimensional structure and operates as an open-ended parallel plate waveguide, but with asymmetrical conductor terminations. The uniplanar dual strip antenna provides increased bandwidth and a reduction in size over other antenna designs while retaining other characteristics that are desirable for use in wireless communication devices.

Since the uniplanar dual strip antenna has a two-dimensional structure, it can be conformably bonded to, or supported by, a variety of surfaces such as the plastic housing of a cellular phone or other wireless device. The uniplanar antenna can be built near the top or bottom surfaces of a wireless communication device such as a portable phone or may be mounted adjacent to or behind other elements such as speakers, ear phones, I/O circuits, keypads, and so forth in the wireless device. The uniplanar antenna can also be built onto or into a surface of a vehicle in which a wireless communication device may be used.

Unlike either a whip or external helical antenna, the uniplanar dual strip antenna is not susceptible to damage by catching on objects or surfaces. Also, since the uniplanar dual strip antenna can be built on near a top surface of a wireless communication device or along a wall, it will not consume interior space which is needed for advanced features and circuits, nor require large housing dimensions to accommodate when retracted. The antenna of the present invention can be manufactured using automated processes reducing labor and costs associated with antennas, and increasing reliability. Furthermore, the uniplanar dual strip antenna radiates a nearly omnidirectional pattern, which makes it suitable in many wireless communication devices.

2. Example Environment Before describing the invention in detail, it is useful to describe an exemplary environment in which the invention can be implemented. In a broad sense, the invention can be implemented in any wireless device, such as a personal communication device, wireless telephones, wireless modems, facsimile devices, portable computers, pagers, message broadcast receivers, and so forth. One such environment is a portable or handheld wireless telephone, such as that used for cellular, PCS or other commercial communication services. A variety of such wireless telephones, with corresponding different housing shapes and styles, are known in the art.

Figure 1B:
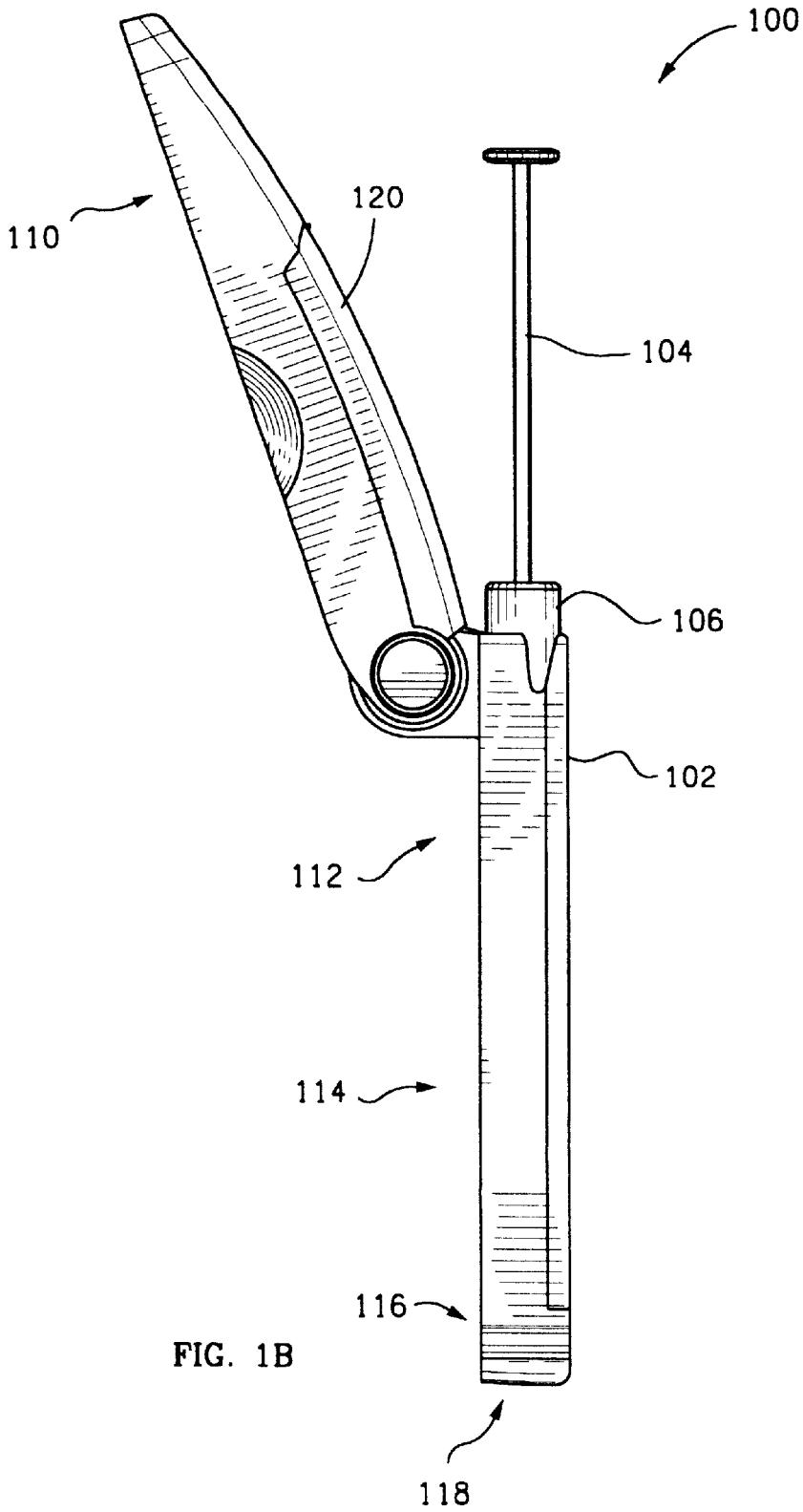

FIGS. 1A and 1B illustrate a typical wireless telephone 100 used in wireless communication systems, such as the cellular and PCS systems discussed above. The wireless phone shown in FIG. 1 (1A, 1B) has a "clam shell," folding body, or flip-type telephone configuration for compactness. Other wireless devices and telephones employ more traditional "bar" shaped housings or configurations.

The telephone illustrated in FIG. 1 includes a whip antenna 104 and a helical antenna 106, concentric with the whip, protruding from a housing 102. The front of the housing is shown supporting a speaker 110, a display panel or screen 112, keypad 114, a microphone or microphone access holes 116, external power source connector 118, and a battery 120, which are typical wireless phone components, well known in the art. In FIG. 1B, antenna 104 is shown in an extended position typically encountered during use, while in FIG. 1A, antenna 104 is shown retracted (not seen due to viewing angle). This phone is used for purposes of illustration only, since there are a variety of wireless devices and phones, and associated physical configurations, in which the present invention may be employed.

As discussed above, antenna 104 has several disadvantages. One is that it is subject to damage by catching on other objects or surfaces when extended during use, and sometimes when retracted. It also consumes interior space of the phone in such a manner as to make placement of components for advanced features and circuits, including power sources such as batteries, more restrictive and less flexible. In addition, antenna 104 may require minimum housing dimensions when retracted that are unacceptably large. Antenna 106 also suffers from catching on other items or surfaces during use, and cannot be retracted into phone housing 102.

The present invention is described in terms of this example environment. Description in these terms is provided for purposes of clarity and convenience only. It is not intended that the invention be limited to application in this example environment. After reading the following description, it will become apparent to a person skilled in the relevant art how to implement the invention in alternative environments. In fact, it will be clear that the present invention can be utilized in any wireless communications device, such as, but not limited to, a portable facsimile machine or portable computer with wireless communications capabilities, and so forth, as discussed further below.

Figure 2:
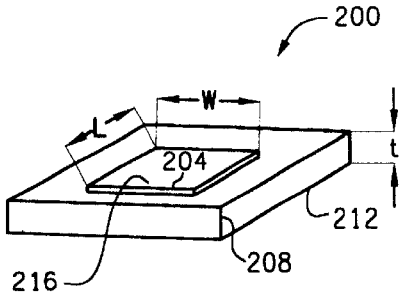
FIG. 2 illustrates a conventional microstrip patch antenna.

FIG. 2 shows a conventional microstrip patch antenna 200. Antenna 200 includes a microstrip element 204, a dielectric substrate 208, a ground plane 212 and a feed point 216. Microstrip element 204 (also commonly referred to as a radiator patch) and ground plane 212 are each made from a layer of conductive material, such as a plate of copper.

The most commonly used microstrip element, and associated ground plane, consists of a rectangular element, although microstrip elements and associated ground planes having other shapes, such as circular, are also used. A microstrip element can be manufactured using a variety of known techniques including being photo etched on one side of a printed circuit board, while a ground plane is photo etched on the other side, or another layer, of the printed circuit board. There are various other ways a microstrip element and ground plane can be constructed, such as by selectively depositing conductive material on a substrate, bonding plates to a dielectric, or coating a plastic with a conductive material.

Figure 3:
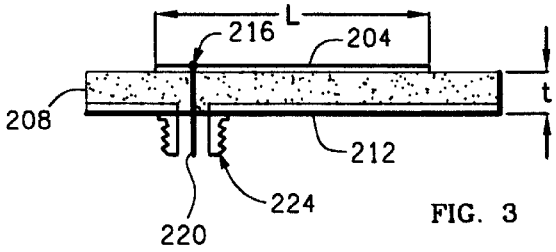
FIG. 3 illustrates a side view of the microstrip patch antenna of FIG. 2.

FIG. 3 shows a side view of conventional microstrip antenna 200. A coaxial cable having a center conductor 220 and an outer conductor 224 is connected to antenna 200. Center conductor (positive terminal) 220 is connected to microstrip element 204 at feed point 216. Outer connector (negative terminal) 224 is connected to ground plane 212. The length L of microstrip element 204 is generally equal to one-half or one-quarter wavelength at the frequency of interest in dielectric substrate 208 (See chapter 7, page 7–2, *Antenna Engineering Handbook, Second Edition*, Richard C. Johnson and Henry Jasik), and is expressed by the relationship:

$$L = 0.5\lambda_d = 0.5\lambda_0 / \sqrt{\varepsilon_r}, \quad \text{or}$$

-continued $$L = 0.25\lambda_d = 0.25\lambda_0 / \sqrt{\varepsilon_r}$$

where L=length of microstrip element 204

$\epsilon_r$=relative dielectric constant of dielectric substrate 208

$\lambda_0$=free space wavelength $\lambda_d$=wavelength in dielectric substrate 208

The variation in dielectric constant and feed inductance makes it hard to predict exact dimensions, so a test element is usually built to determine the exact length. The thickness t is usually much less than a wavelength, usually on the order of 0.01 $\lambda_0$, to minimize or prevent transverse currents or modes. The selected value of t is based on the bandwidth over which the antenna must operate, and is discussed in further detail later.

The width "w" of microstrip element 204 must be less than a wavelength in the dielectric substrate material, that is, $\lambda_d$, so that higher-order modes will not be exited. An exception to this is where multiple signal feeds are used to eliminate higher-order modes.

A second microstrip antenna commonly used is the quarter wavelength microstrip antenna. The ground plane of the quarter wavelength microstrip antenna generally has a much larger area than that of the microstrip element. The length of the microstrip element is approximately a quarter wavelength at the frequency of interest in the substrate material. The length of the ground plane is approximately one-half wavelength at the frequency of interest in the substrate material. One end of the microstrip element is electrically connected to the ground plane.

The bandwidth of a quarter wavelength microstrip antenna depends on the thickness of the dielectric substrate. As stated before, PCS and cellular wireless phone operations require a bandwidth of approximately 8 percent. In order for a quarter wavelength microstrip antenna to meet the 8 percent bandwidth requirement, the thickness of dielectric substrate 208 must be approximately 1.25 inches for the cellular frequency band (824–894 MHz) and 0.5 inches for the PCS frequency band. This large of a thickness is clearly undesirable in a small wireless or personal communication device, where a thickness of approximately 0.25 inches or less is desired. An antenna with a larger thickness typically cannot be accommodated within the available volume of most wireless communication devices.

3. The Present Invention

Figure 4:
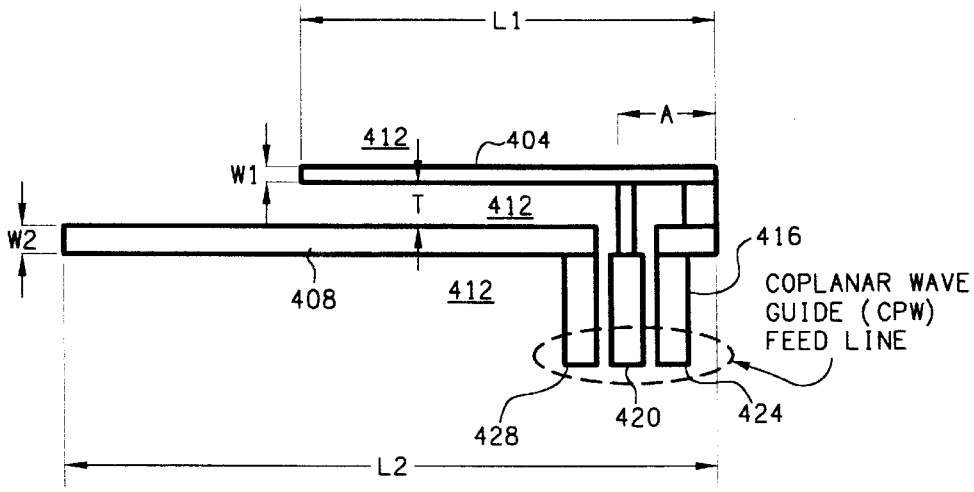
FIG. 4 illustrates a uniplanar dual strip antenna in accordance with one embodiment of the present invention.

A uniplanar dual strip antenna 400 which is constructed and operating according to one embodiment of the present invention is shown in FIG. 4. In FIG. 4, uniplanar dual strip antenna 400 includes a first strip 404 and a second strips 408, a dielectric substrate 412, and a coplanar waveguide 416. First strip 404 is electrically connected to second strip 408 at or adjacent to one end. This end is referred to as the "closed end", 406, for antenna 400.

First and second strips 404 and 408 are each printed, etched or deposited on dielectric substrate 412, and are each made of a conductive material such as, for example, copper, brass, aluminum, silver, gold or other known conductive materials, subject to known impedance and current characteristics. First and second strips 404 and 408 are spaced from each other by a predetermined gap t, which could also be filled with a dielectric material (normally air) such as a foam known for such uses, as desired. In one embodiment of the present invention, first and second strips 404 and 408 are positioned substantially parallel to one another over their respective lengths. In another embodiment (see, for example, FIGS. 5A–5C and 9B), the first and second strips flare out at an open end in order to provide better impedance matching with air or free space.

A coplanar waveguide 416 having a positive terminal 420 and two negative terminals 424 and 428 is coupled to first and second strips 404 and 408. In one embodiment of the present invention, positive and negative terminals 420, 424 and 428 are formed by three parallel metallic strips. The center strip is designated as positive terminal 420 and is electrically connected to first strip 404. One outer strip is designated as negative terminal 424 and the other outer strip is designated as negative terminal 428. Negative terminal 424 is electrically connected to first strip 404 and negative terminal 428 is electrically connected to second strip 408. In one embodiment of the present invention, coplanar waveguide 416 is constructed by printing, etching or depositing metal on dielectric substrate 412. Coplanar waveguide 416 is made from a conductive material, such as copper, silver, gold, aluminum or other known conductive materials. Alternatively, a coaxial cable can be used as a feed in lieu of a coplanar waveguide.

Uniplanar dual strip antenna 400 has a two-dimensional structure. Thus, it can be conformably bonded to many surfaces, such as the plastic housing of a cellular phone. In one embodiment of the present invention, antenna 400 is etched, printed or deposited on a flexible sheet capable of functioning as a dielectric substrate or medium, such as Mylar, Kapton, or other known flexible dielectric material. The dual strip antenna can be advantageously mounted on thin portions of wireless devices, such as the flip-type, clam shell or folding portion of a wireless mobile telephone, as discussed below.

The lengths of first and second strips 404 and 408 primarily determine the resonant frequency of uniplanar dual strip antenna 400. The length of first and second strips 404 and 408 are sized appropriately so that first and second strips 404 and 408 act as a two-wire transmission line capable of receiving and transmitting signals having a preselected desired frequency. The method of selecting appropriate lengths for first and second strips 404 and 408 so as to operate as a two-wire transmission line at a desired frequency is well known in the art. Briefly stated, in order for first and second strips 404 and 408 to perform as a two-wire transmission line, each must have a length of approximately $\lambda/4$, where $\lambda$ is the wavelength at the frequency of interest of an electromagnetic wave. Next, the bandwidth of the resulting antenna formed by the two-wire transmission line is increased. This is done by simultaneously reducing the length and the width of the first strip while increasing the length and the width of the second strip until a desired bandwidth is achieved.

Coplanar waveguide 416 couples a signal unit (not shown) to dual strip antenna 400. Note that the signal unit is used herein to refer to the functionality provided by a signal source and/or signal receiver. Whether the signal unit provides one or both of these functionalities depends upon how antenna 400 is configured to operate. Antenna 400 could, for example, be configured to operate solely as a transmission element, in which case the signal unit operates as a signal source. Alternatively, the signal unit operates as a signal receiver when antenna 400 is configured to operate solely as a reception element. The signal unit provides both functionalities, in the form of a transceiver, when antenna 400 is configured to operate as both a transmission and a reception element.

The antenna or strips can be formed in a variety of other shapes such as, but not limited to, quarter-circular, semi-circular, semi-elliptical, parabolic, angular, both circular and squared C-shaped, L-shaped, U-shaped, and V-shaped. The V-shaped structures can vary from less than 90 degree to almost 180 degree. The curved structures can use relatively small or large radii. The width of the conductors, i.e., the first and second strips, can be changed along the length such that they taper, curve, or otherwise stepwise change to a narrow width toward the outer end (non-feed portion). As will be clearly understood by those skilled in the art, several of these effects or shapes can be combined in a single antenna structure.

Several top plan views of alternative embodiments or shapes for the strips of the present invention are shown in FIGS. 5A–5G, 6A–6C, 7A–7E and 8A–8F, where the last digit of the reference numerals indicates whether an item is a first or second strip, that is, 4 or 8, respectively. The first number and last character indicate the figure in which the element appears, as in 504A for FIG. 5A, 708B for FIG. 7B, and so forth. For purposes of clarity in illustration the widths for the strips used in these figures is not to scale and is usually the same. However, as discussed above, and elsewhere, and as would be readily apparent, these two strips will generally have differing widths to achieve a desired bandwidth.

The antenna embodiments shown in FIGS. 5A–5G illustrate alternative shapes for the present invention using rectangular or square transitions to connect the strips together. That is, for the closed end of the antenna in the embodiments shown in FIGS. 5A–5G, the first and second strips are connected or joined together using a substantially straight conductive connection element or transition strip 506 (506A–506G). In addition, further changes in direction for the strips relative to each other are accomplished with substantially square corners. Each change in direction involves positioning a new portion of each strip substantially perpendicular, or at a 90 degree angle, to a previous portion. Of course, these angles need not be precise for most applications and other angles can be employed, along with curved or chamfered corners, as desired.

Figure 5A:
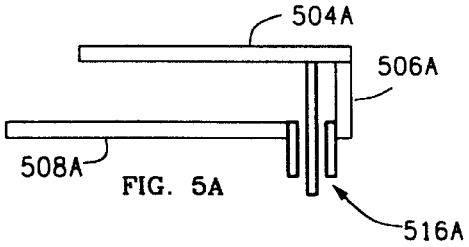
FIGS. 5A–5G illustrate top plan views of several alternative embodiments of the present invention using square transitions to connect strips.
Figure 5B:
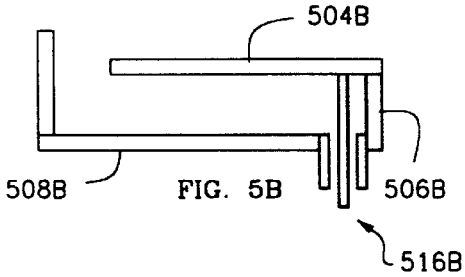
Figure 5C:
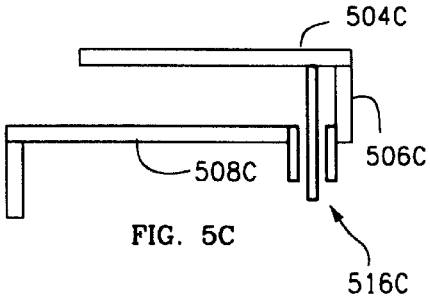
Figure 5D:
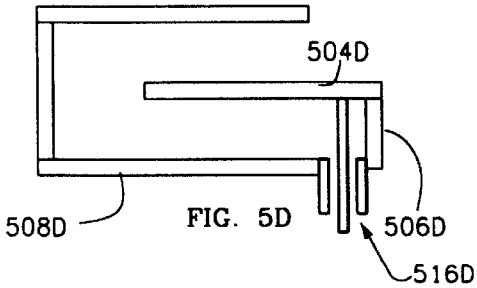
Figure 5E:
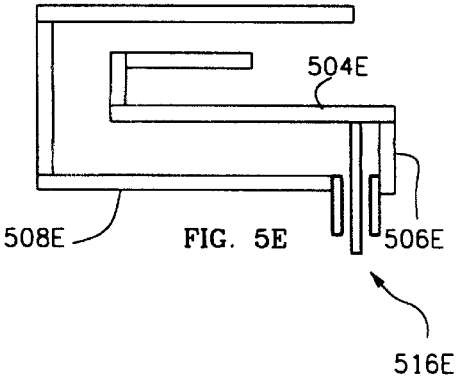
Figure 5F:
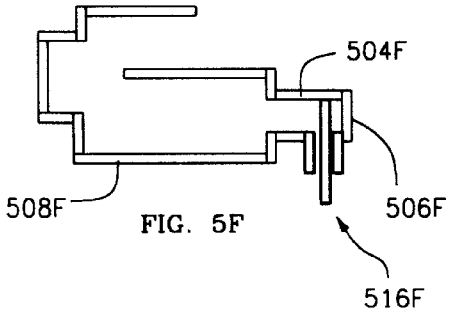
Figure 5G:
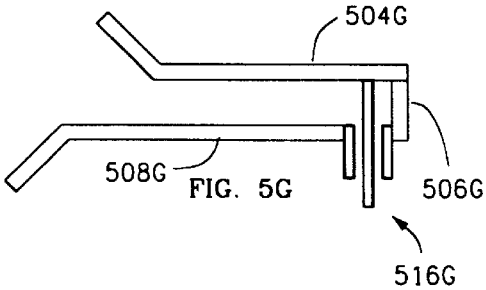

FIG. 5B shows that in order to accommodate a longer second strip, that strip can be folded to maintain an overall desired length for the antenna structure. FIG. 5C shows that the fold can be either toward or away from the plane in which the first strip lays. FIG. 5D shows that the second strip can be folded back around, either partially or completely, the first strip. While FIG. 5E shows the extension of the first strip through a folded architecture as well. FIG. 5F shows changes in direction for the first and second strips being accomplished in smaller "steps". Alternatively, an end portion of each strip can be bent or directed at an angle, as shown in FIG. 5G, to form an overall Y-shape. Typically, the separation angle is a 90 degree angle, although not required, as where a more obtuse Y-shaped end structure is acceptable.

Figure 6A:
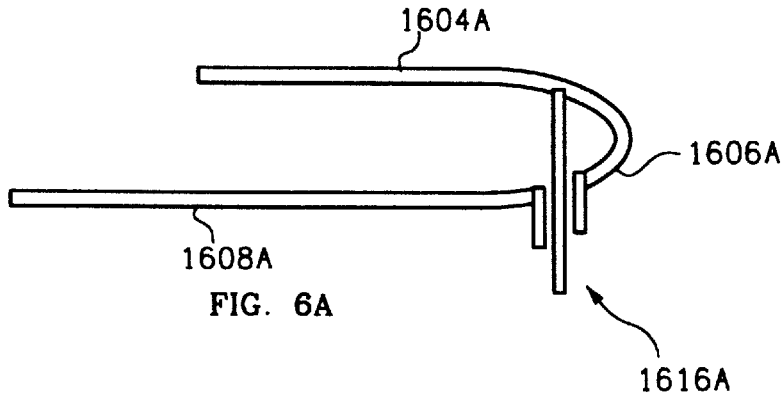
FIGS. 6A–6C illustrate top plan views of several other alternative embodiments of the present invention using curved transitions to connect strips.
Figure 6B:
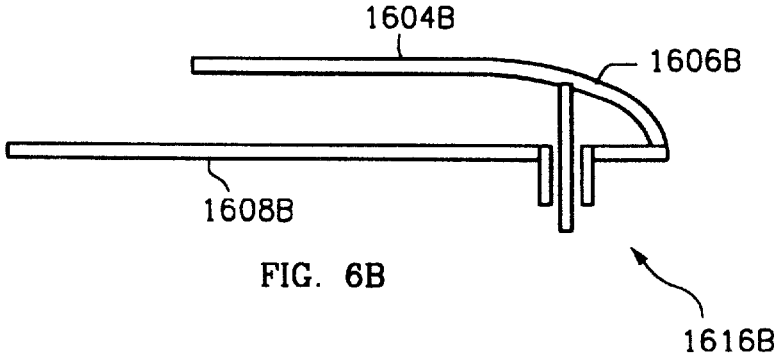
Figure 6C:
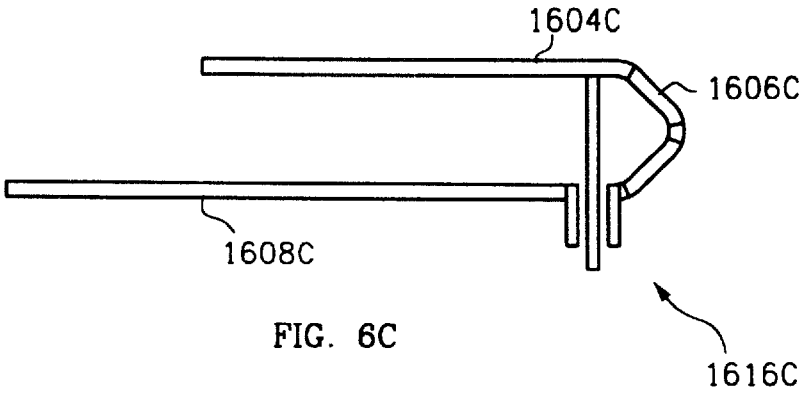

The antenna embodiments shown in FIGS. 6A–6C illustrate alternative shapes for the present invention using curved or curvilinear transitions to connect the strips together. That is, in the embodiments shown in FIGS. 6A–6C, the first and second strips are connected or joined together at the closed end using a curved conductive connection element or transition strip 606. Strip 606 can have a variety of shapes including, but not limited to, quarter-circular, semi-circular, semi-elliptical, or parabolic, or combinations of thereof. The curved structures can use relatively small or large radii, as desired for a particular application. In addition, each of the strips can be folded to maintain an overall desired length for the antenna structure, as shown in FIGS. 5A–5G. FIG. 6A shows a generally semi-circular curved transition, FIG. 6B shows a generally quarter-circular, or elliptical, curved transition, and FIG. 6C shows a generally parabolic curved transition. These types of transitions can also be used in combination.

The antenna embodiments shown in FIGS. 7A–7E illustrate alternative shapes for the present invention using V-shaped transitions to connect the strips together. That is, in the embodiments shown in FIGS. 7A–7E, the first and second strips are connected or joined together at the closed end without using a separate conductive connection element or transition strip, or by using a very small one. Instead, the first and second strips extend from a common joint in an outward separation or flared configuration. In addition, as before, each of the strips can be folded to maintain an overall desired length for the antenna structure, as shown in FIGS. 5A–5H.

Figure 7A:
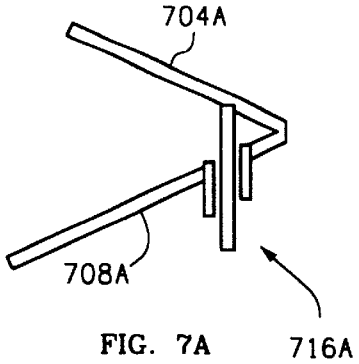
FIGS. 7A–7E illustrate top plan views of another several alternative embodiments of the present invention using V-shaped transitions to connect strips.
Figure 7B:
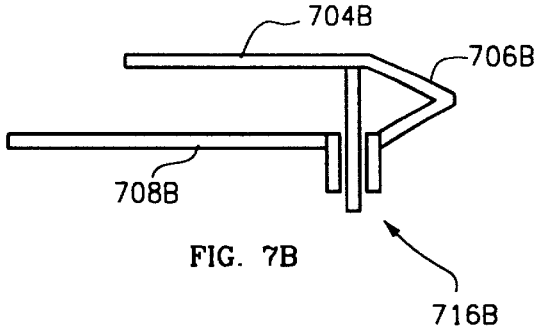
Figure 7C:
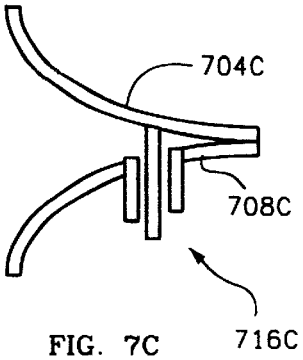
Figure 7D:
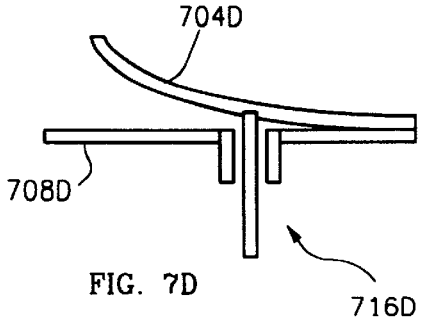
Figure 7E:
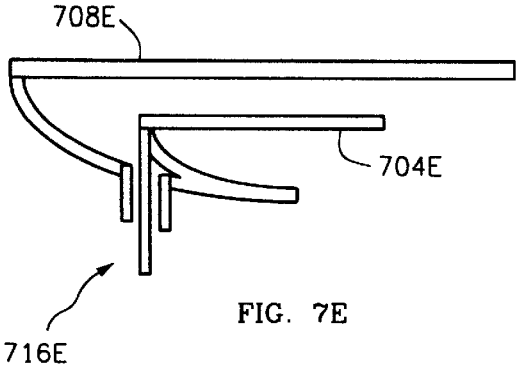
Figure 8A:
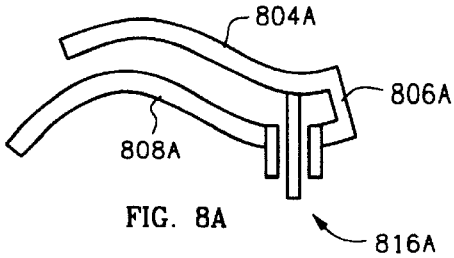
FIGS. 8A–8G illustrate top plan views of additional alternative embodiments of the present invention using curved, angled, and compound strip shapes.
Figure 8D:
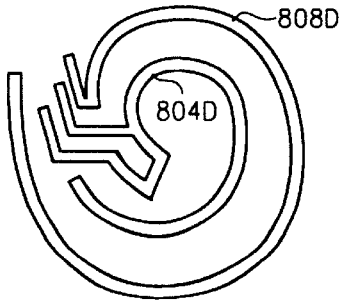
Figure 8B:
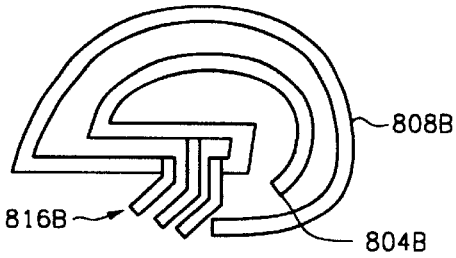
Figure 8E:
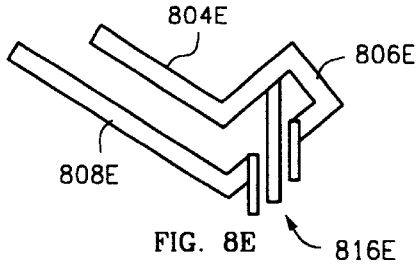
Figure 8C:
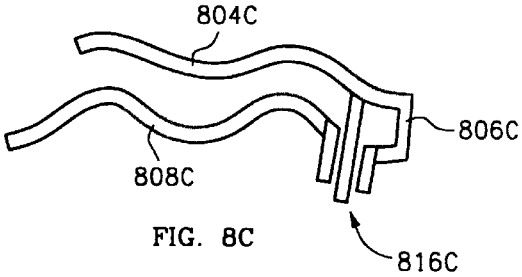
Figure 8F:
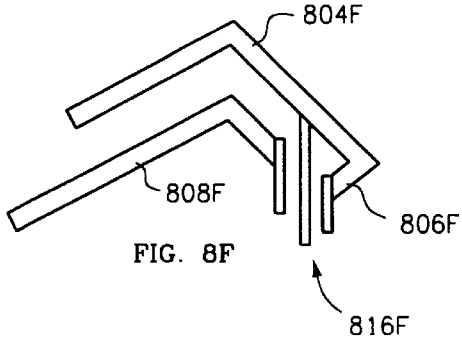
Figure 8G:
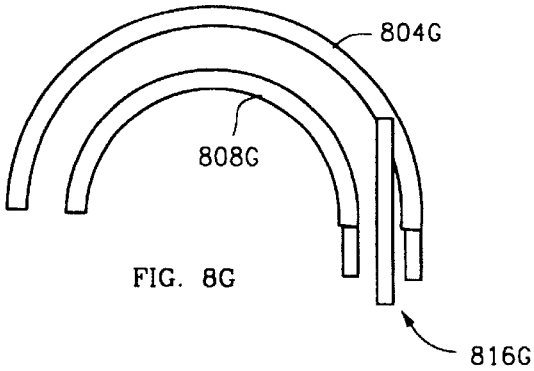

FIGS. 7A and 7B, show a generally straight V-shaped or acute angular transition where they join together. In FIG. 7B, the two strips bend again to form generally parallel strips, or to provide a decreased angular slope with respect to each other. In FIGS. 7C–7E, at least one of the two strips is curved after the initial V-shaped joint. In FIG. 7C, both strips are curved, such as in following an exponential or parabolic curve function. In FIG. 7D, only one strip is curved, and in FIG. 7E, both strips are curved, but fold into straight sections. As before, these types of transitions can also be used in combination, as desired, for a particular application.

FIGS. 8A–8G illustrate several alternative embodiments or shapes for the strips of the present invention using curved, angled, and compound strips. Here, the strips are positioned substantially parallel to each other over their respective lengths, but follow circular, serpentine, or V-shaped paths extending outward from where they are connected or joined together at the closed end using a conductive connection element or transition strip 806 (806A–806F), or in the circular or elliptical case of FIG. 8G no connecting strip is used. The use of compound shapes allows formation of the antenna structure on support substrates that also support circuitry or discrete components and devices, or to allow for clearance passages around other devices within a target wireless device.

While this antenna structure is a two-dimensional structure residing in a single plane, is a conformal or conformable structure such that the plane need not be flat. That is, by curving or shaping the support substrate the shape of the uniplanar antenna can also effectively vary in a third dimension. A pair of strips that appear as flat planar surfaces in two dimensions can be curved along an arc or be bent at an angle in a third dimension (here z). Several embodiments of the present invention wherein a pair of strips curve or bend in the z direction are shown in FIGS. 9A–9C. These embodiments are very useful when it is desired to place the antenna within certain spaces in a wireless device which might require the antenna to be "fit" around certain components or structures within the device.

FIG. 9A shows the first and second strips as seen in FIG. 4 also being curved along their respective lengths, in a third dimension, using a simple curve. FIG. 9B shows the first and second strips as seen in FIG. 7A being connected together in a V-shape or acute angular transition but viewed in three dimensions with a V-shaped offset. A more complex set of curves or folds are used to shape the plane in which the strips reside in FIG. 9C.

Dual strip antenna 400 can also be constructed by etching or depositing a metallic strip on two opposing sides of a dielectric substrate and electrically connecting the metallic strips together at one end by using one or more plated through vias, jumpers, connectors, or wires. In this form, antenna 400 utilizes some of the substrate material as a dielectric positioned between the two strips. This is taken into account in designing the antenna as far as bandwidth and other characteristics as would be well known. Dual strip antenna 400 can also be constructed by molding or forming a plastic or other known insulative or dielectric material into a support structure having a desired shape (U-, V-, or C-shaped, or curved, rectangular, and so forth) and then plating or covering the plastic with conductive material over appropriate portions using well known methods, including conductive material in liquid form.

The dielectric substrate can be secured within portions of the wireless device housing using posts, ridges, channels, or the like formed in the material used to manufacture the housing. That is, such supports are molded, or otherwise formed, in the wall of the device housing when manufactured, such as by injection molding. These support elements can then hold the substrate in position when inserted over or inside of them, during assembly of the phone. Other techniques include using an layer of adhesive material to secure the assembly within the device housing, or some form of fastener or retainer interacting with holes in, or the edges of, the substrate.

As stated before, according to the present invention, first and second strips 404 and 408 (504, 508; 604, 608; 704, 708; 804, 808 etc.) operate as a two-wire transmission line. One advantage of a two-wire transmission line is that it does not require a ground plane. This allows antenna 400 to be a two-dimensional structure having negligible thickness. The majority of the thickness of antenna 400 is determined by the thickness of dielectric substrate 412. For example, a thin sheet of Mylar or Kapton having a thickness in the range of 0.0005 inches to 0.002 inches can be used as a dielectric substrate. In contrast, a conventional microstrip antenna designed for cellular frequency band operation requires a dielectric substrate having a thickness of 1.25 inches, while a microstrip antenna designed for the PCS frequency band requires a dielectric substrate having a thickness of 0.5 inches. Thus, the present invention allows substantial reduction in the overall thickness of the antenna, thereby making it more desirable for personal communication devices, such as a PCS or a cellular phone. However, those skilled in the art will readily recognize that other thicknesses can be used including thicker material to maintain a desired structural integrity for the antenna, either when in use or during mounting in manufacturing or servicing of the wireless device.

The uniplanar dual strip antenna 400 according to the present invention provides an increase in bandwidth over typical quarter wave-length or half wave-length patch antennas. Experimental results have shown that antenna 400 has a bandwidth of approximately 8–20 percent, which is extremely desirable for PCS and cellular phones. As noted before, conventional microstrip antennas have very narrow bandwidth, making them less desirable for use in personal communication devices.

In the present invention, the increase in bandwidth is made possible primarily by operating antenna 400 as a two-wire transmission line, rather than as a conventional microstrip patch antenna. Unlike a conventional microstrip patch antenna having a radiator patch and a ground plane, in antenna 400, both first and second strips 404 and 408 act as active radiators. In other words, the length and the width of first and second strips are carefully sized so that both the first and second strips 404 and 408 perform as active radiators, at the wavelength or frequency of interest. During operation of antenna 400, surface currents are induced in the first strip as well as in the second strip. Initially, the present inventor selected appropriate dimensions, that is the length and the width, of the first and second strips by using analytical methods and EM simulation software that are well known in the art. Thereafter, the present inventor verified the simulation results by experimental methods known in the art.

In order to enhance the radiator or antenna bandwidth, the dimensions of each strip, in a preferred embodiment, are chosen to establish different center frequencies which are related to each other in a preselected manner. For example, say that $f_0$ is the desired center frequency of the antenna. The length of the shorter strip can be chosen such that its center frequency resides at or around $f_0+\Delta f$, and the length of the longer strip such that its center frequency is at or around $f_0-\Delta f$. This provides the antenna with a wide bandwidth on the order of from $3\Delta f/f_0$ to $4\Delta f/f_0$. That is, the use of the +/− frequency offset relative to $f_0$ results in a scheme that enhances the antenna radiator bandwidth. In this configuration, $\Delta f$ is selected to be much smaller in magnitude than $f_0$ ($\Delta f << f_0$) so the resonant frequency separation of the two strips is small. Its is believed that the antenna will not perform satisfactorily if $\Delta f$ is chosen to be as large as $f_0$. In other words, this is not intended for use as a dual-band antenna with each strip acting as an independent antenna radiator.

In the present invention, the increase in bandwidth is achieved without a corresponding increase in the size of the antenna. This is contrary to the teachings of conventional patch antennas in which the bandwidth is generally increased by increasing the thickness of the patch antennas, thereby resulting in larger overall size of the patch antennas.

In one example embodiment of the present invention, antenna 400 is sized appropriately for the cellular frequency band, i.e., 824–894 MHz. The dimensions of antenna 400 for the cellular frequency band is given below in Table 1.

TABLE 1

| | |
|---|---|
| length (L1) of first strip 404 | 2.4 inches |
| length (L2) of second strip 408 | 4.53 inches |
| width (W1) of first strip 404 | 0.062 inches |
| width (W2) of second strip 408 | 0.125 inches |
| gap (t) between first and second strips 404 and 408 | 0.125 inches |

In the above example embodiment, 1 oz copper was used to construct first and second strips 404 and 408, and 0.031 inch thick FR4 (a well known commercially available printed circuit board (PCB) material) was used as dielectric substrate 412. Also, the positive terminal of coplanar waveguide 416 was connected to first strip 404 at a distance of 0.330 inches from the closed end of antenna 400.

Figure 10:
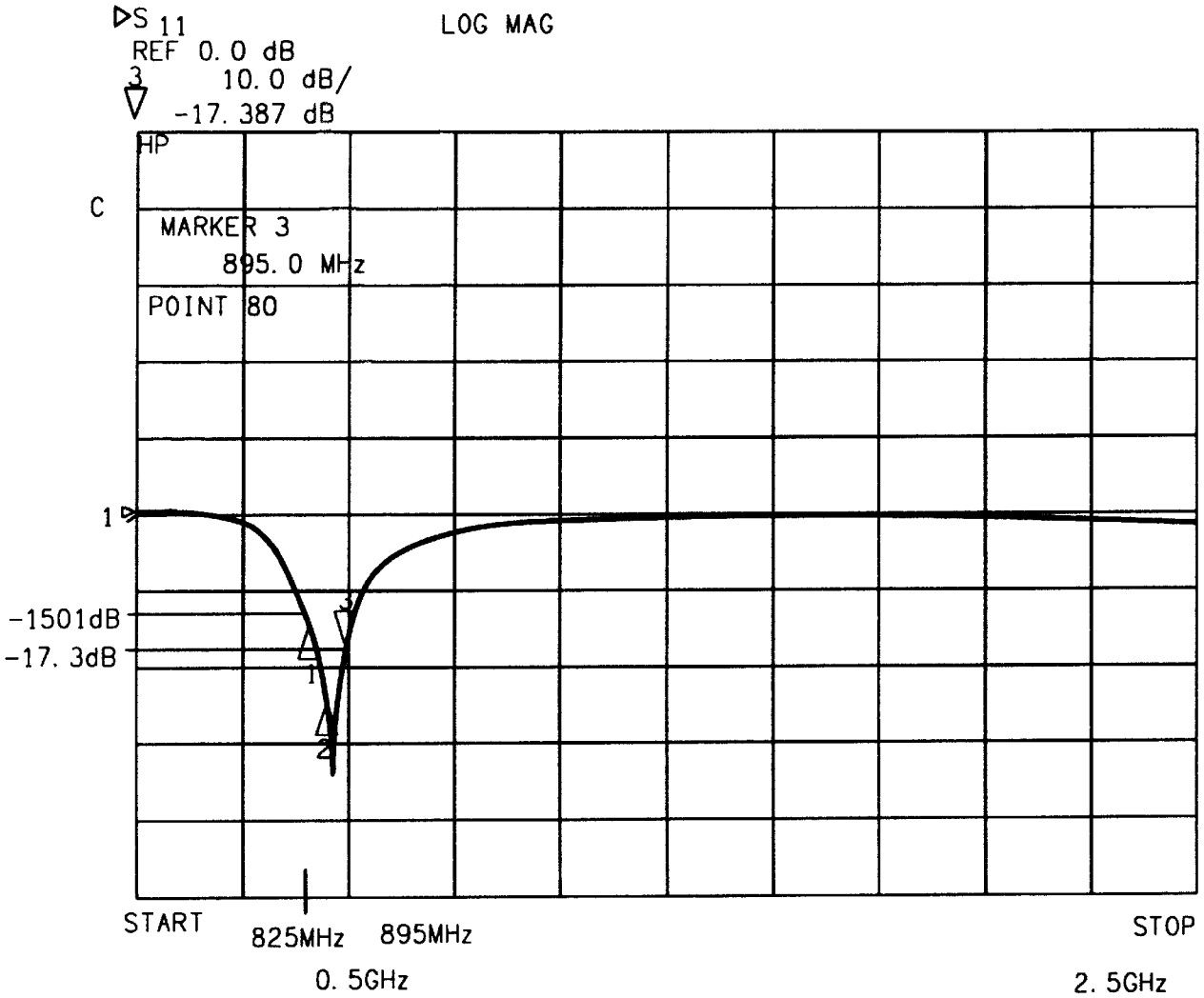
FIG. 10 illustrates a measured frequency response of one embodiment of the present invention suitable for use in cellular phones.

FIG. 10 shows the measured frequency response of one embodiment of antenna 400 sized to operate over the cellular frequency band. FIG. 10 shows that the antenna has a −15.01 dB frequency response at 825 MHz and a −17.38 dB frequency response at 895.0 MHz. Thus, the antenna has a 8.14 percent bandwidth.

In another example embodiment of the present invention, antenna 400 is sized to operate over the PCS frequency band, i.e., 1.85–1.99 GHz. The dimensions of antenna 400 for the PCS frequency band is given below in Table 2.

TABLE 2

| | |
|---|---|
| length (L1) of first strip 404 | 0.89 inches |
| length (L2) of second strip 408 | 2.10 inches |

TABLE 2-continued

| | |
|---|---|
| width (W1) of first strip 404 | 0.062 inches |
| width (W2) of second strip 408 | 0.125 inches |
| gap (t) between first and second strips 404 and 408 | 0.125 inches |

In the above example embodiment, 1 oz copper was again used to construct first and second strips 404 and 408, and 0.031 inch thick FR4 (PCB material) was used as dielectric substrate 412. Also, the positive terminal of coplanar waveguide 416 was connected to first strip 404 at a distance of 0.2 inches from the closed end of antenna 400.

Figure 11:
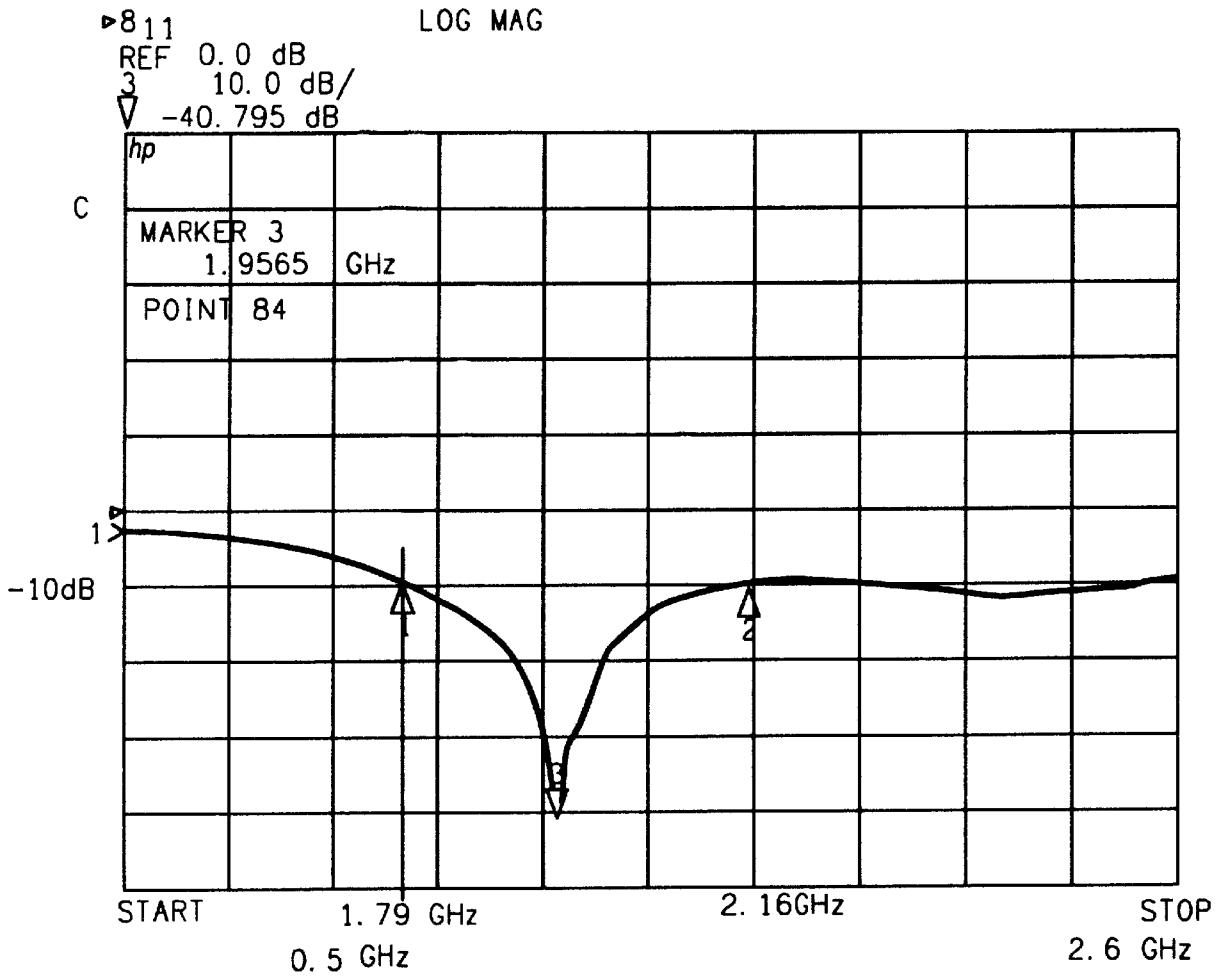
FIG. 11 illustrates a measured frequency response of another embodiment of the present invention suitable for use in PCS wireless phones.

FIG. 11 shows the measured frequency response of one embodiment of antenna 400 sized to operate over the PCS frequency band. FIG. 11 shows that the antenna has a −9.92 dB response at 1.79 GHz and a −10.18 dB response at 2.16 GHz. Thus, in this embodiment antenna 400 has an 18.8 percent bandwidth.

Figure 12:
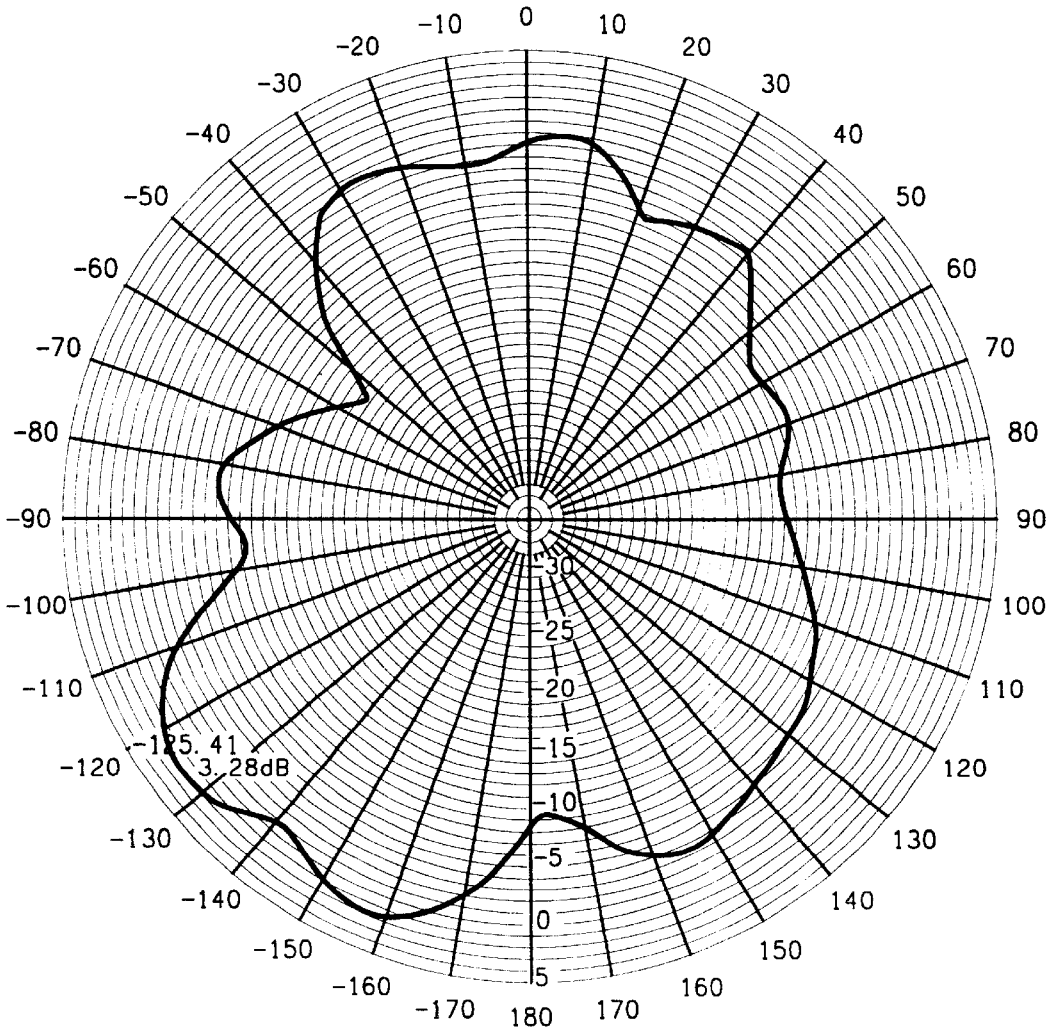
FIGS. 12 and 13 illustrate measured field patterns for one embodiment of the present invention.
Figure 13:
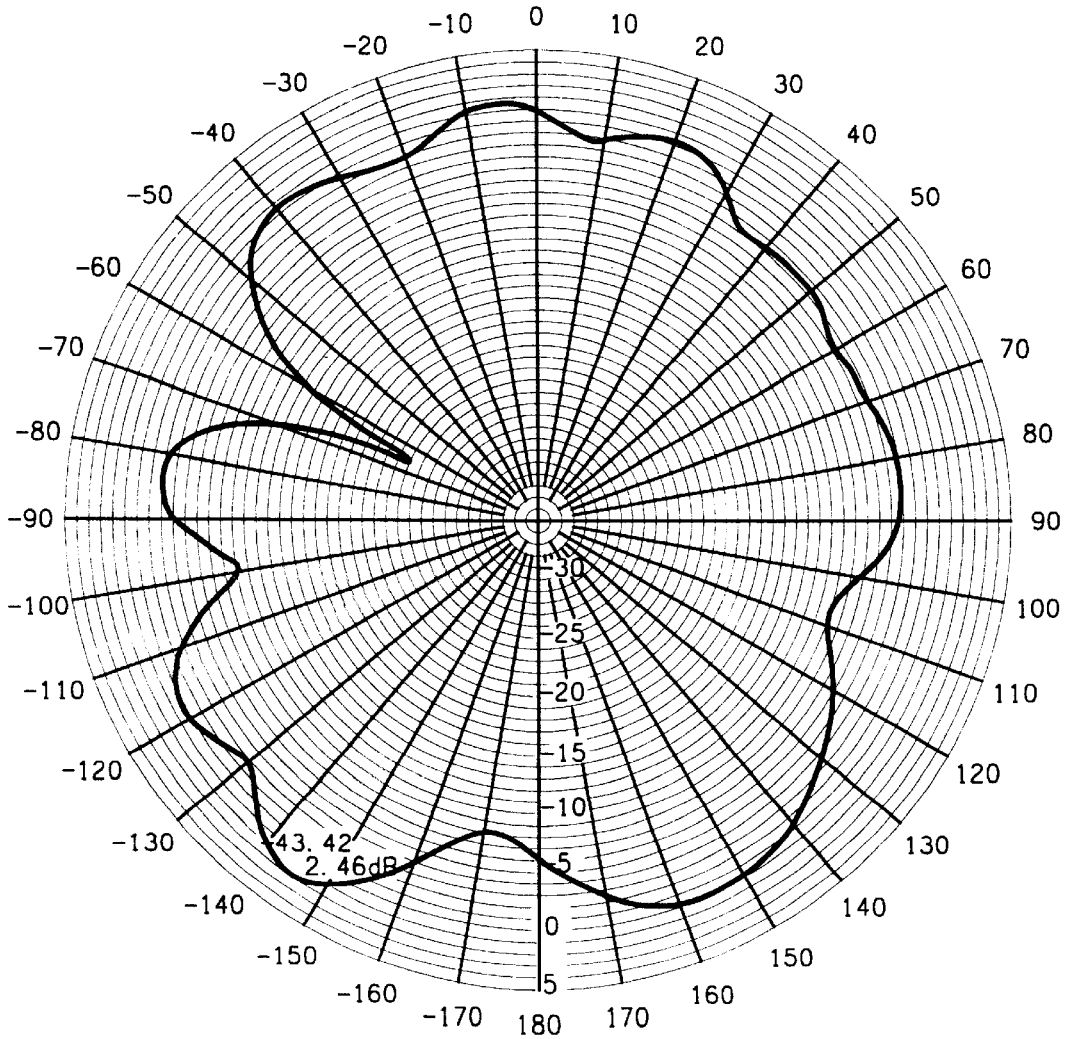

FIGS. 12 and 13 show the measured field patterns of one embodiment of antenna 400 operating over the PCS frequency band. Specifically, FIG. 12 shows a plot of magnitude of the field pattern in the azimuth plane, while FIG. 13 shows a plot of magnitude of the field pattern in the elevation plane. Both FIGS. 12 and 13 show that the dual strip antenna has an approximately omnidirectional radiation pattern, thereby making it suitable for use in personal communication devices.

Figure 14:
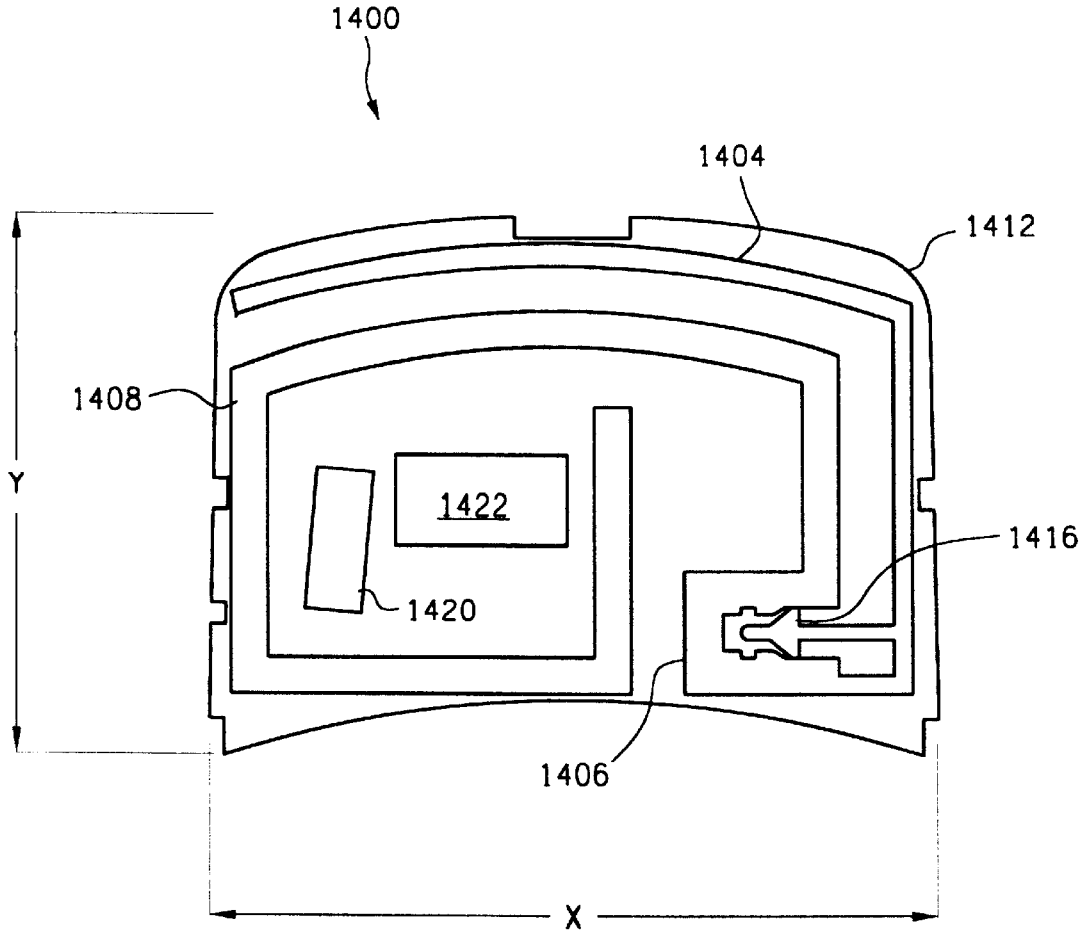
FIG. 14 illustrates a top view of one embodiment of the present invention for use in the phone of FIG. 1.

One embodiment was developed using a "D" shaped radiator strip arrangement with the second strip being much longer than the first and generally folded to extend "inside" and away from the first, even folded back into itself, as desired. This antenna structure is illustrated in FIG. 14 where an antenna 1400 is formed using strips 1404 and 1408 positioned or disposed on a substrate 1412. The top portion of the antenna is formed by first conductive strip 1404 which is shown as being slightly curved in the "C" shape (or leading edge of D). This curvature is used to allow placement of antenna 1400 in, and adjacent to the side of, a device housing having curved sidewalls. The second strip is wider than the first strip, as discussed above, to improve bandwidth.

A model of such an antenna was constructed and tested having overall dimensions on the order of 37.59 mm (Y) by 51.89 mm (X), which corresponded roughly to the interior dimension of the flip-top portion of a clamshell type wireless telephone where the antenna was positioned.

Antenna 1400 is connected to appropriate transceiver circuitry within a wireless device using a feed section 1416. Element 1420 illustrates how various known circuit components or devices can also be mounted on substrate 1412, or alternatively passages or holes 1422 can be formed through which various components or cables extend, as desired.

Figure 15:
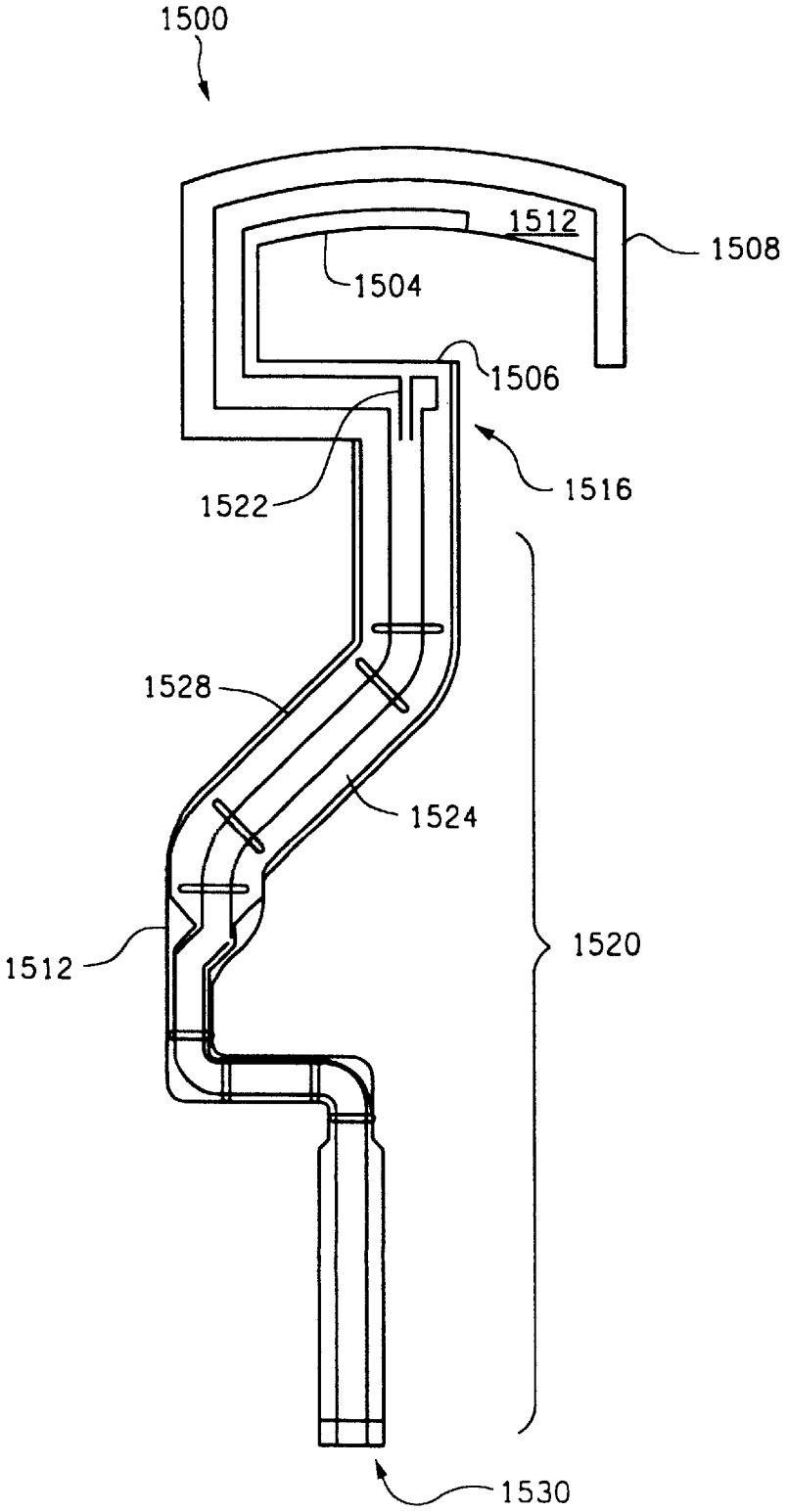
FIG. 15 illustrates a top view of another embodiment of the present invention and a signal feed structure for use in the phone of FIG. 1.

A preferred embodiment was also developed using a D shaped radiator strip arrangement with the second strip being much longer and wider than the first and generally extending to "wrap around" the first. Such an antenna structure is illustrated in FIG. 15, where an antenna 1500 is formed using strips 1504 and 1508 positioned or disposed on a substrate 1512. Again, the top portion of antenna 1500 as formed by the second strip is shown as being slightly curved to allow improved placement of antenna 1500 in a wireless device.

This type of antenna can be formed as a unitized structure with the conductors that are used to feed the signals. The coaxial feed structure can be formed on the same flexible substrate (1512) as the conductors forming the antenna. For example, on a thin sheet of Mylar, Kapton, or Teflon based material, all being well known materials in the art. An example of how this can be accomplished is illustrated in FIG. 15, where a long flexible signal feed structure or section 1520 in the form of a "coplanar waveguide" is shown. Waveguide 1520 terminates or connects on one end to negative feed strips 1524 and 1528 which form part of the ground portion of a coplanar waveguide. Feed strip 1524 connects or is coupled to connecting element 1506 while feed strip 1528 is connected to second strip 1508. A positive feed strip 1522, or the center of feed structure 1520, is connected directly to first strip 1504. The separation between the connection point for this feed strip and strip 1528 is selected to provide a predetermined impedance in accordance with the frequency being used and the length, and other dimensions, of conductive material 1506, as would be known.

Positive feed 1522 is shown terminating a short distance along material 1512 and is generally connected or coupled to, or widens to become a third center conductor 1526 similar to conductors 1524 and 1528. Conductor 1526 extends along the length of material 1512 to connector end 1530, forming the center or positive portion of a coplanar waveguide .

However other configurations including placing one or more feed strip conductors on opposite sides of the substrate could be used. For example the positive feed conductor can be formed on one side of material 1512 and the negative feeds on the other. Conductive vias are then used to transfer signals through the material where appropriate. Other combinations of conductors and vias may be employed to realize signal transfers as would be known.

Therefore, antenna 1500 can be formed along with these conductors (1522, 1524, 1528) as a single monolithic structure, providing increased efficiency in cost, reliability, and manufacturing efficiency. The conductors (1524, 1526, 1528) on feed section 1520 typically terminate in conductive pads or a small connector 1532 which are used to connect to various spring action or loaded connectors on a circuit board to which the antenna is coupled.

The configuration or overall shape for waveguide or feed portion 1520 and substrate 1512 used in FIG. 15 is for purposes of illustration only, and for fitting most efficiently within wireless device 100, as shown. However, those skilled in the art will readily understand that other configurations may be useful and are within the teachings of the invention. For example, instead of using angled bends along the length of waveguide 1520 which are approximately 45 degree angles, a series of 90 degree bends, folds, or turns can be used for the conductors. Clearly, when small cables are used, a variety of bends and turns can be employed. Such folds and turns are used to minimize the path length of conductors while accommodating physical constraints applied to the substrate or antenna. In addition, conductors 1524, 1526, and 1528 are typically narrowed in width at one or more points along waveguide 1520, and those locations may also change in accordance with specific applications. The small air-bridges shown in FIG. 15 for electrically joining conductors 1524 and 1528, are useful but not required by the invention.

When placed inside a wireless device, such as wireless telephone 100, feed structure or waveguide 1520 allows efficient transfer of signals between antenna 1500 and various receive and transmit elements and components used within the wireless device. By forming the antenna and coplanar waveguide on a common but thin and flexible dielectric substrate, the antenna can be mounted within many portions of a device, since it takes very little space and can be formed around many other discrete components such as speakers. The feed conductors and can make connections around flexible, rotating or collapsible joints, such as found in many wireless devices (phones, computers.).

Alternatively, a mini coaxial line could be used in place of waveguide (feed) 1520 to achieve similar results. For example, a known type of coaxial line or cable having a 0.8 mm or 1.2 mm diameter has shown that it could be useful in transferring signals between antenna 1500 and the corresponding or appropriate circuitry, as desired. Other styles and types of conductors may be used for certain applications depending on signal transfer characteristics, as would be known.

Figure 16A:
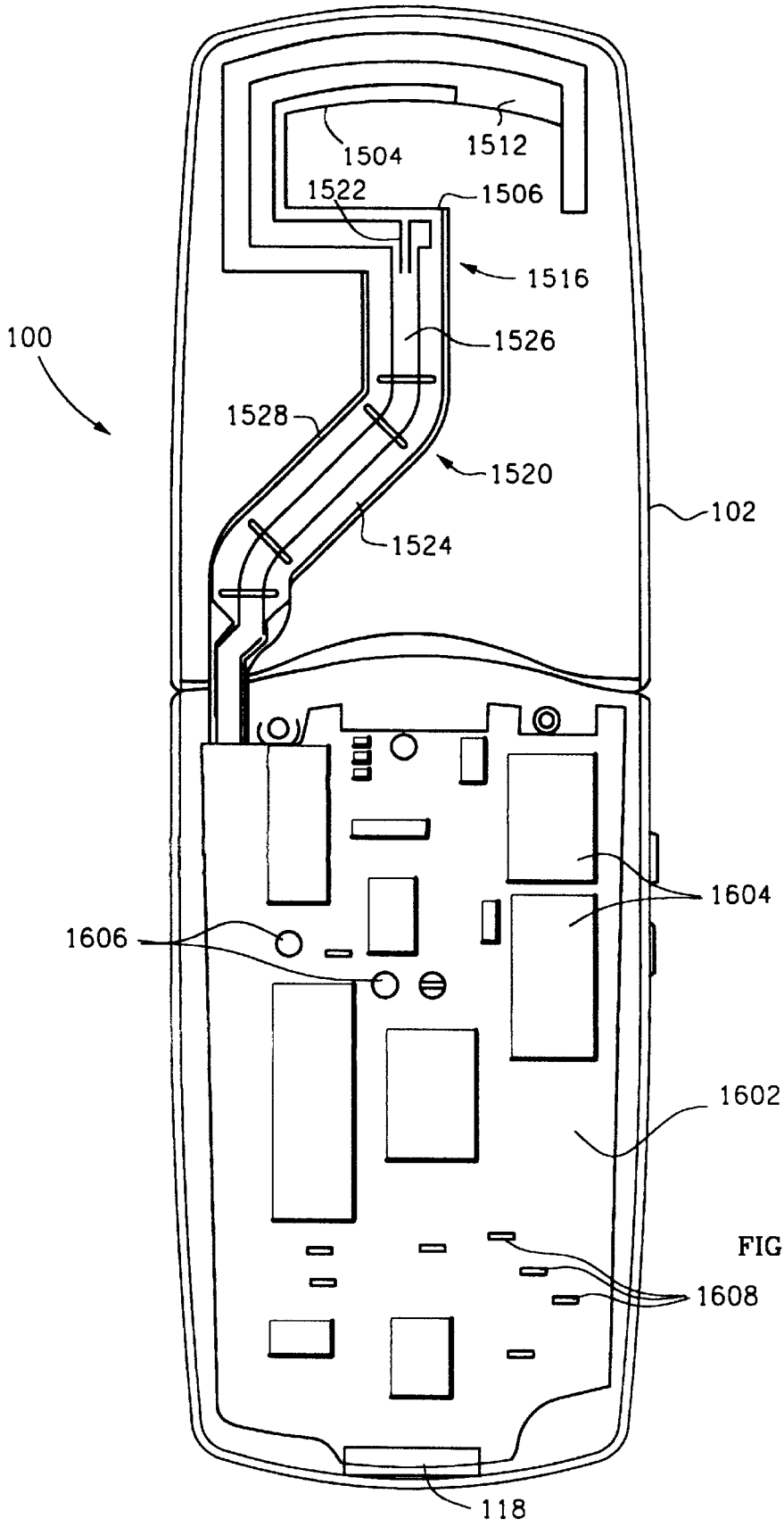
FIGS. 16A and 16B illustrate bottom plan and side cross-sectional views of one embodiment of the present invention mounted within the phone of FIG. 1.
Figure 16B:
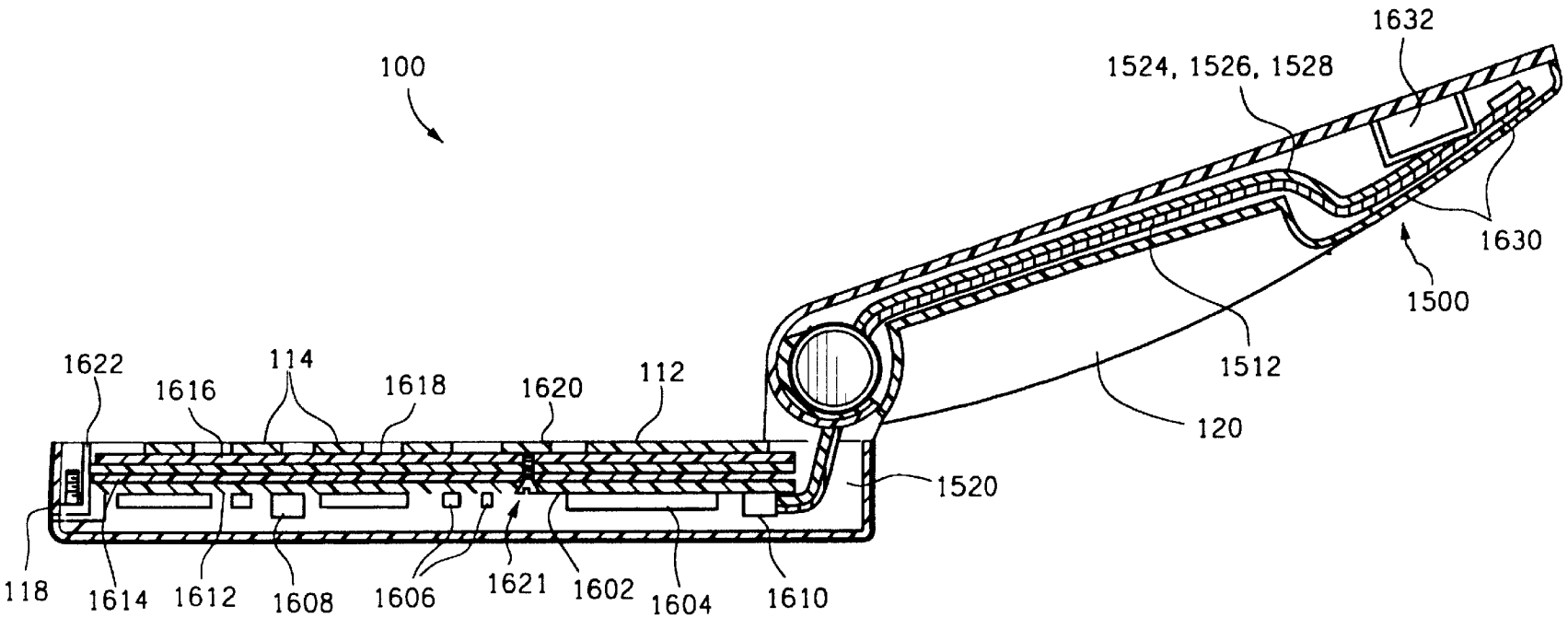

FIGS. 16A and 16B illustrate side and rear cutaway section views, respectively, of one embodiment of the present invention mounted within telephone 100 of FIG. 1. Such phones have various internal components generally supported on one or more circuit broads for performing the various functions needed or desired. A circuit board 1602 is shown inside of housing 102 in FIGS. 16A and 16B supporting various components such as integrated circuits or chips 1604, discrete components 1606, such as resistors and capacitors, and various connectors 1608. The panel display and keyboard are typically mounted on the reverse side of board 1602, facing the front of phone housing 102, with wires, conductors, and connectors (not shown) interfacing various other components, like the battery or external power supply, speaker, microphone, or other similar well known elements to the circuitry on board 1602.

In this embodiment, a slide-in or plug-in type connector 1610 is mounted on the underside of the board, near to the front of the phone, and is configured to accept the connection end of feeder section 1520 for antenna 1500. Alternatively, one or more known spring contacts or clips can be used to contact conductive pads on end 1530 and electrically couple or connect antenna 1500 to board 1602. Such spring contacts or clips are mounted on circuit board 1602 using well known techniques such as soldering or conductive adhesives, and are electrically connected to appropriate conductors to transfer signals to and from desired transmit and receive circuits. However, other types of connection techniques, including the use of solder, or the use of miniature coaxial connectors (when small cable is used) are also known to be useful. There may also be specialized impedance matching elements or circuits, as desired, and as well known, used within the wireless device to interconnect with the feed structure.

In the side view of FIG. 16B, circuit board 1602 is shown as comprising multiple layers of conductive and dielectric materials, bonded together to form what is referred to in the art as a multi-layer or printed circuit board (PCB). Such boards are well known and understood in the art. This is illustrated as dielectric material layer 1612 disposed next to metallic conductor layer 1614 disposed next to dielectric material layer 1616 supporting or disposed next to metallic conductor layer 1618. Conductive vias (not shown) are used to interconnect various conductors on different layers or levels with components on the outer surfaces Etched patterns on any given layer determine interconnection patterns for that layer. In this configuration, either layer 1614 or 1618 could form a ground layer or ground plane, as it is commonly referred to, for board 1602, as would be known in the art.

Typically, a series of support posts, stands, or ridges 1620 are used for mounting circuit boards or other components within the housing. These can be formed as part of the housing, such as when it is formed by injection molding plastic, or otherwise secured in place, such as by using adhesives or other well known mechanisms. In addition, there are typically one or more fastening posts 1622 used to receive fasteners to secure portions, such as removable covers, of housing 102 to each other.

As discussed earlier, antenna 1500 can be secured within portions of housing 102 using several known techniques such as, but not limited to, the use of adhesives, glues, tapes, potting compounds, or bonding compounds and the like, known to be useful for this function. For example, antenna 1500 can be supported against a side wall or other portion or element of the wireless device using an adhesive layer or strip 1630 bonded to substrate 1512. The antenna is generally secured against the side of the housing, preferably over an insulating material, or against a bracket assembly which can be mounted in place using brackets, screws, or similar fastening elements.

Alternative mechanisms for mounting or securing the antenna in place are known in the art. For example, ridges, channels, or the like formed in the material used to manufacture the housing can be used to physically secure the substrate in place. A series of protrusions or bumps can also be used to support the antenna, and can have various shapes as appropriate for the desired application.

As seen in FIG. 16B, substrate 1512 could be curved or otherwise bent to closely match the shape of the housing or to accommodate other elements, features, or components within the wireless device. In the figure, a speaker 1632 is shown positioned with the antenna radiators or strips "wrapped" around a portion of it.

The substrate can be manufactured in a curved or folded shape or deformed during installation. Using a thin substrate allows the substrate to be when installed, sometimes providing tension or pressure against flexed or bent adjacent surfaces to generally secure the substrate in place without the need for fasteners. Some form of capturing is then accomplished simply by installing adjacent devices, components, or circuit boards and covers or portions of the housing that are fastened in place. However, there is no requirement to deform or curve the substrate either during manufacture or installation in order for the present invention to operate properly.

Figure 17:
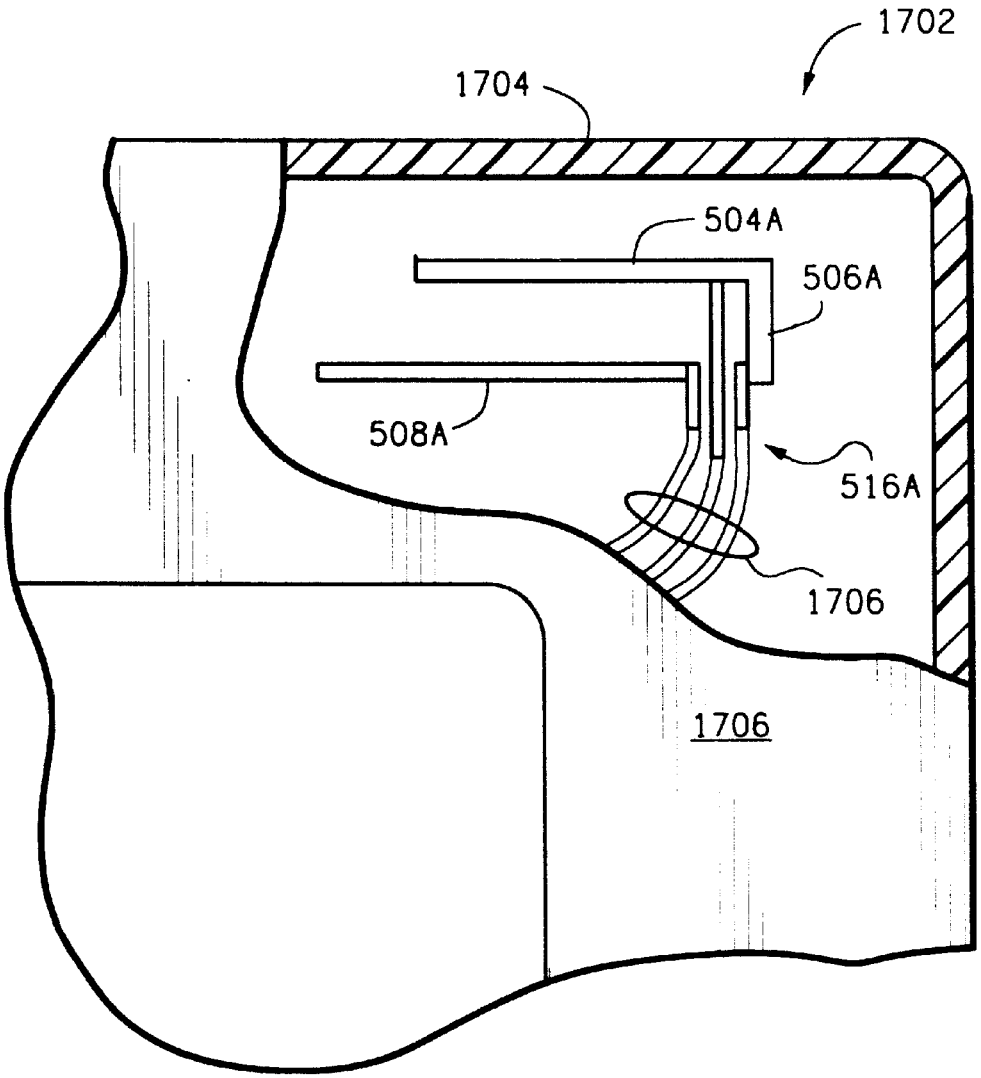
FIG. 17 illustrates an additional wireless device in which the present invention may be used.

FIG. 17 illustrates additional wireless devices in which the present invention may be used such as, but not limited to, a portable computer, modem, data terminal, facsimile machine, or similar portable electronic device. In FIG. 17, a wireless device or equipment using a wireless device 1700 is shown having a main housing or body 1702 with an upper corner section 1704. In the cutaway view of FIG. 17, antenna 500 is secured in place in upper corner 1704 and a cable or conductor set 1708 is used to connect the antenna feed 516 to appropriate circuitry within the wireless device. Those skilled in the art will readily understand that other configurations and orientations are possible for the antenna within the teachings of the invention.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What I claim as my invention is:

1. A uniplanar dual strip antenna comprising a first electrically conductive metallic strip and an electrically conductive metallic second strip mounted on a single face of a dielectric substrate, said first and second strips being spaced from each other by a selected constant gap, wherein the length and the width of said first and second strips are selected such that they form a two wire transmission line for receiving and transmitting electromagnetic energy, further comprising a coplanar waveguide having a positive and a negative terminal, said coplanar waveguide being formed by disposing metal on the same face of said substrate, the positive terminal being electrically coupled to said first strip and the negative terminal being electrically coupled to said first and second strips, wherein surface currents are formed on said first and second strips when said uniplanar dual strip antenna is energized by electrical signals via said coplanar waveguide.

2. The uniplanar dual strip antenna as recited in claim 1, wherein said first and second strips comprise metallic strips printed on the same face of said dielectric substrate.

3. The uniplanar dual strip antenna as recited in claim 1, wherein said first and second strips comprise metallic strips deposited on the same face of said dielectric substrate.

4. The uniplanar dual strip antenna as recited in claim 1, wherein said first strip is substantially parallel to said second strip.

5. The uniplanar dual strip antenna as recited in claim 1, wherein the length of said first strip is less than the length of said second strip.

6. The uniplanar dual strip antenna as recited in claim 1, wherein the length of said first strip is equal to the length of said second strip.

7. The uniplanar dual strip antenna as recited in claim 1, wherein the width of said first strip is less than the width of said second strip.

8. The uniplanar dual strip antenna as recited in claim 1, wherein the width of said first strip is equal to the width of said second strip.

9. The uniplanar dual strip antenna as recited in claim 1, wherein said dielectric substrate is a flexible sheet capable of acting as a dielectric medium.

10. The uniplanar dual strip antenna as recited in claim 1, wherein the length and width of said first and second strips are sized so that said uniplanar dual strip antenna is capable of receiving and transmitting signals having a frequency range of 1.85–1.99 GHz.

11. The uniplanar dual strip antenna as recited in claim 1, wherein the length and width of said first and second strips are sized so that said uniplanar dual strip antenna is capable of receiving and transmitting signals having a frequency range of 824–894 MHz.

12. A uniplanar dual strip antenna comprising a first electrically conductive metallic strip and an electrically conductive metallic second strip mounted on a dielectric substate, said first and second strips being spaced from each other by a selected constant gap, wherein the length and the width of said first and second strips are selected such that they form a two wire transmission line for receiving and transmitting electromagnetic energy, wherein said first and second strips are formed on opposite faces of said dielectric substrate.

13. A uniplanar dual strip antenna comprising a first electrically conductive metallic strip and an electrically conductive metallic second strip mounted on a dielectric substrate, said first and second strips being spaced from each other by a selected constant gap, wherein the length and the width of said first and second strips are selected such that they form a two wire transmission line for receiving and transmitting electromagnetic energy, further comprising a coplanar waveguide having positive and negative terminals, said coplanar waveguide being formed by disposing metal on the same face of said substrate, the positive terminal being electrically coupled to said first and second strips and the negative terminal being electrically coupled to said second strip, wherein surface currents are formed on said first and second strips when said uniplanar dual strip antenna is energized by electrical signals via said coplanar waveguide.

* * * * *